US005206963A

United States Patent [19]

Wiens

[11] Patent Number: 5,206,963

[45] Date of Patent: May 4, 1993

[54] APPARATUS AND METHOD FOR A WATER-SAVING SHOWER BATH

[76] Inventor: Donald E. Wiens, 19475 Silver Hope Road, Hope, B.C., Canada, V0X 1L0

[21] Appl. No.: 530,825

[22] Filed: May 30, 1990

[51] Int. Cl.[5] ..... A47K 3/22

[52] U.S. Cl. ..... 4/603; 4/597; 4/616

[58] Field of Search ..... 4/602, 603, 616, 597, 4/625, 626, 615, 596, 598, 567, 568, 525, 524, 538, 552, 541-543, 545, 546; 137/624.12-624.14; 128/365, 366; 392/465, 480, 485; 219/481

[56] References Cited

U.S. PATENT DOCUMENTS

| | | | |
|---|---|---|---|
| 112,217 | 2/1871 | Brown | 4/603 |
| 211,874 | 2/1879 | Wasson | 4/603 |
| 553,046 | 1/1896 | Wenger | 4/602 |
| 1,065,265 | 6/1913 | Nordmark | 4/601 |
| 3,381,316 | 5/1968 | Anderson | 4/597 |
| 3,606,618 | 9/1971 | Veech | 4/603 |
| 4,042,984 | 8/1977 | Butler | 4/538 X |
| 4,055,863 | 11/1977 | Duval | 4/601 |
| 4,064,570 | 12/1977 | Kim | 4/600 |
| 4,230,155 | 10/1980 | Frye, Sr. et al. | 137/624.12 X |
| 4,409,694 | 10/1983 | Barrett, Sr. et al. | 4/545 |
| 4,432,103 | 2/1984 | Hunzikar | 4/525 |
| 4,453,280 | 6/1984 | Greenleaf | 4/599 |
| 4,638,147 | 1/1987 | Dytch et al. | 219/308 |
| 4,645,907 | 2/1987 | Salton | 392/485 |
| 4,663,613 | 5/1987 | Raleigh et al. | 340/607 |
| 4,716,605 | 1/1988 | Shepherd et al. | 4/544 |
| 4,828,709 | 5/1989 | Houser et al. | 4/603 X |
| 4,867,189 | 9/1989 | Moineau | 137/624.12 X |
| 4,893,364 | 1/1990 | Keeler | 4/597 |
| 4,894,698 | 1/1990 | Hijikigawa et al. | 357/26 |
| 4,944,049 | 7/1990 | Leonard | 4/597 |
| 4,984,314 | 1/1991 | Weigert | 4/596 X |

FOREIGN PATENT DOCUMENTS

| | | | |
|---|---|---|---|
| 3048643 | 7/1982 | Fed. Rep. of Germany | 392/465 |
| 3436941 | 4/1986 | Fed. Rep. of Germany | 4/596 |
| 2432292 | 4/1980 | France | 4/603 |
| 1602191 | 11/1981 | United Kingdom | 4/602 |
| 2140990 | 12/1984 | United Kingdom | 392/465 |

*Primary Examiner*—Henry J. Recla
*Assistant Examiner*—Casey Jacyna
*Attorney, Agent, or Firm*—Hughes & Multer

[57] ABSTRACT

A shower system and a method for receiving and delivering fresh water for a washing operation and also for recirculating the water, comprises a showerhead, a basin, a fresh water inlet, a waste water outlet, a pump means connected to the showerhead and adapted to deliver waste water thereto, and a general valve means. The general valve means has operative connections to the showerhead, to the basin, to the fresh water inlet, and to the waste water outlet. The general valve means has at least three operating positions. In first, second, and third operating positions, respectively, flow connections are made, respectively, between the fresh water inlet and the showerhead; from the basin through the pump to the showerhead; and between the basin and the waste water outlet. Various automatic control features are provided, including overflow control, which is designed to open the waste water outlet after inflow continues beyond a predetermined length of time, and water consumption control which interrupts the inflow when the inflow continues beyond a predetermined length of time.

6 Claims, 14 Drawing Sheets 14
90
92
94
95
96
63
64
+
+
HEATER
PUMP
54
93
34
32
46
30
52
28
44
42
C
H
40
36
38
62
60
54
22
20
48
50
51
301
24
26
18
56
58
10
12
16

14a
63a
+
96a
90a
92a
93a
94a
95a
HEATER
PUMP
87
74
70
86
54a
34a
32a
54a
30a
52a
83
78
80
28a
44a
42a
C
H
40a
82
CIRCUIT
84
65
66
72
68
62a
76
60a
36a
38a
22a
48a
50a
301
24a
26a
18a
56a
58a
10a
12a
16a 14b
98
52b
100
110
102
250
28b
44b
42b
C
H
40b
104
106
150
126
96b
122
128
92b
90b
249
95b
125
86b
87b
130
HEATER
PUMP
CIRCUIT
146
140
142
54b
34b
94b
93b
32b
54b
30b
108
36b
38b
252
60b
254
132
144
301
22b
238
48b
50b
152
148
124
134
136
24b
18b
56b
58b
10b
12b
16b
138 a b
FIG. 4.1
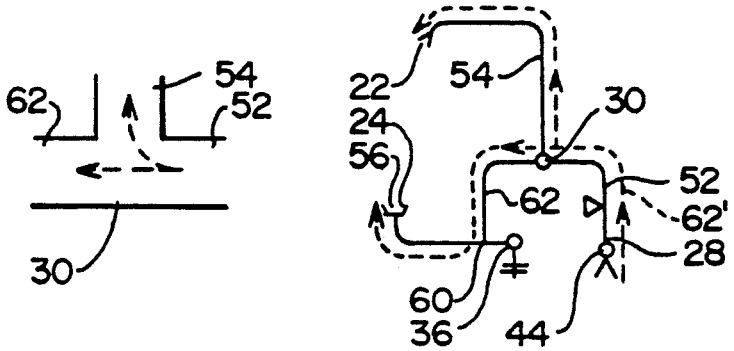
FIG. 4.2
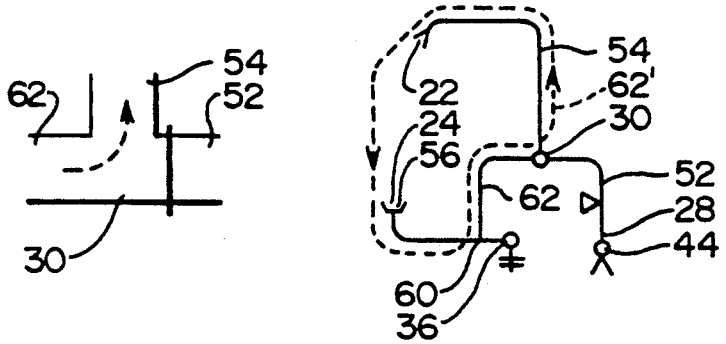
FIG. 4.3
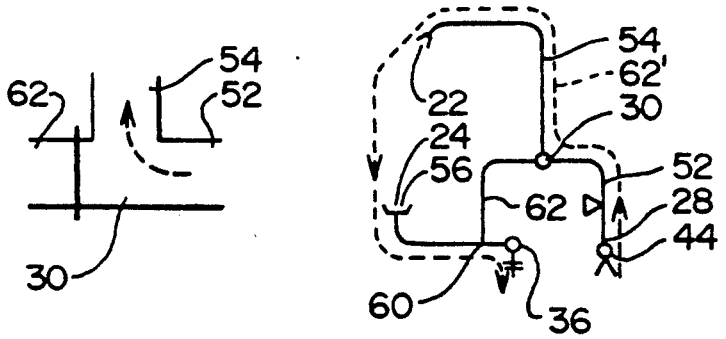
FIG. 4.4
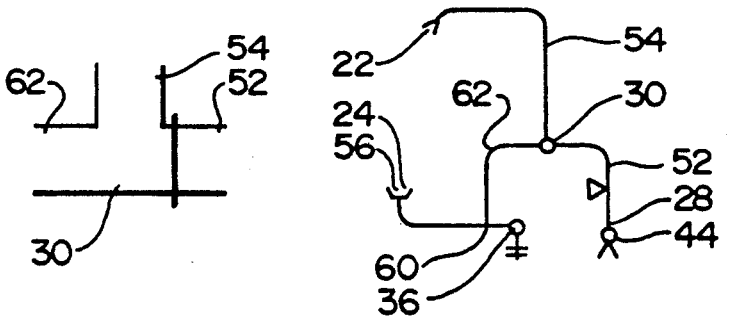

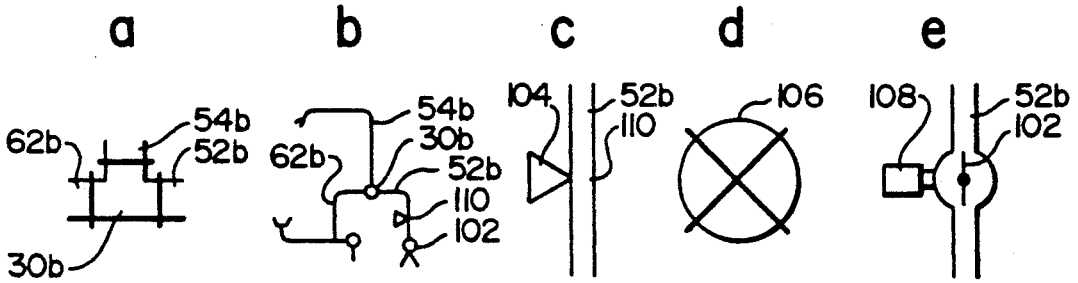
FIG. 6.1
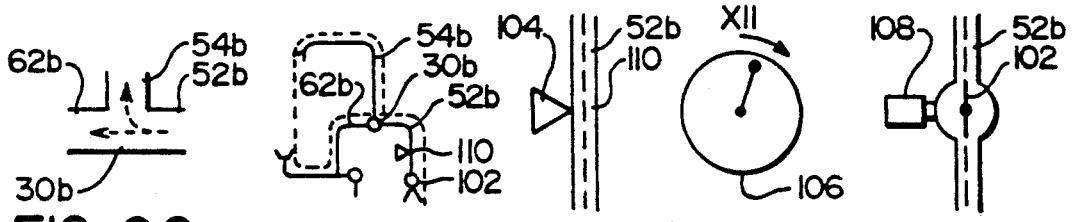
FIG. 6.2
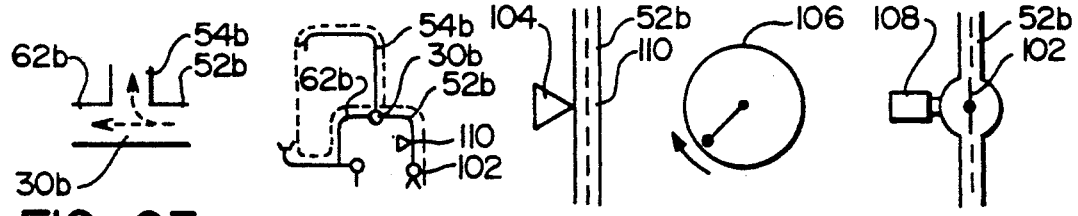
FIG. 6.3
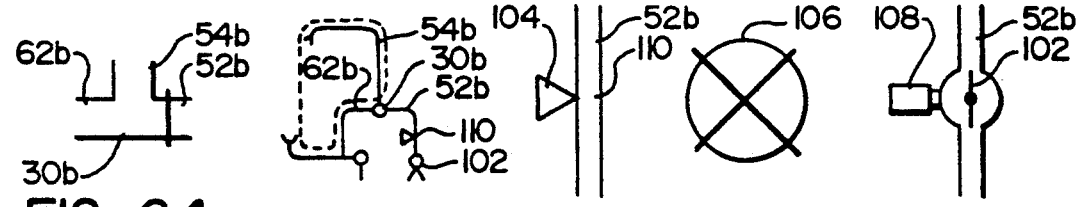
FIG. 6.4

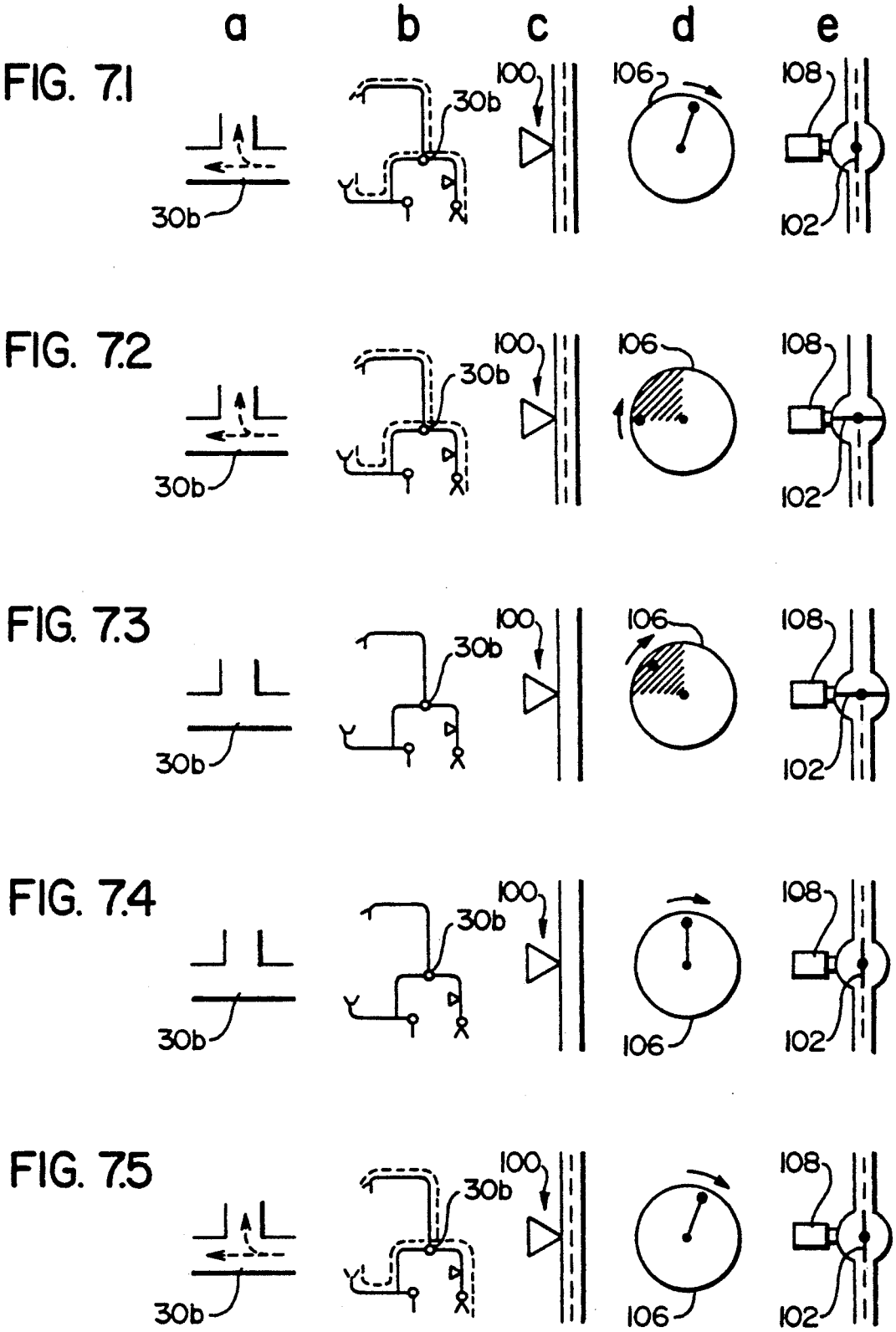
a
b
c
d
e
FIG. 7.1
FIG. 7.2
FIG. 7.3
FIG. 7.4
FIG. 7.5
30b
100
106
108
102

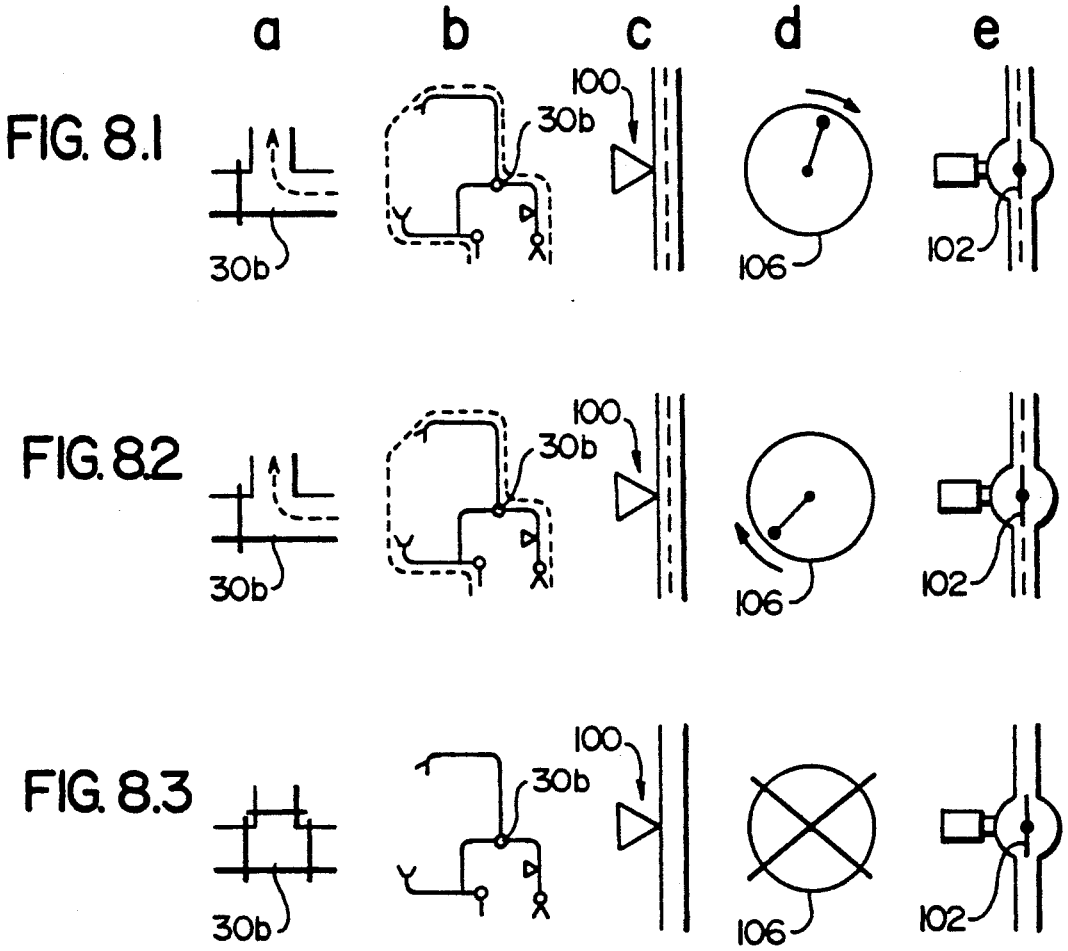
a
b
c
d
e
FIG. 8.1
FIG. 8.2
FIG. 8.3
30b
100
106
102

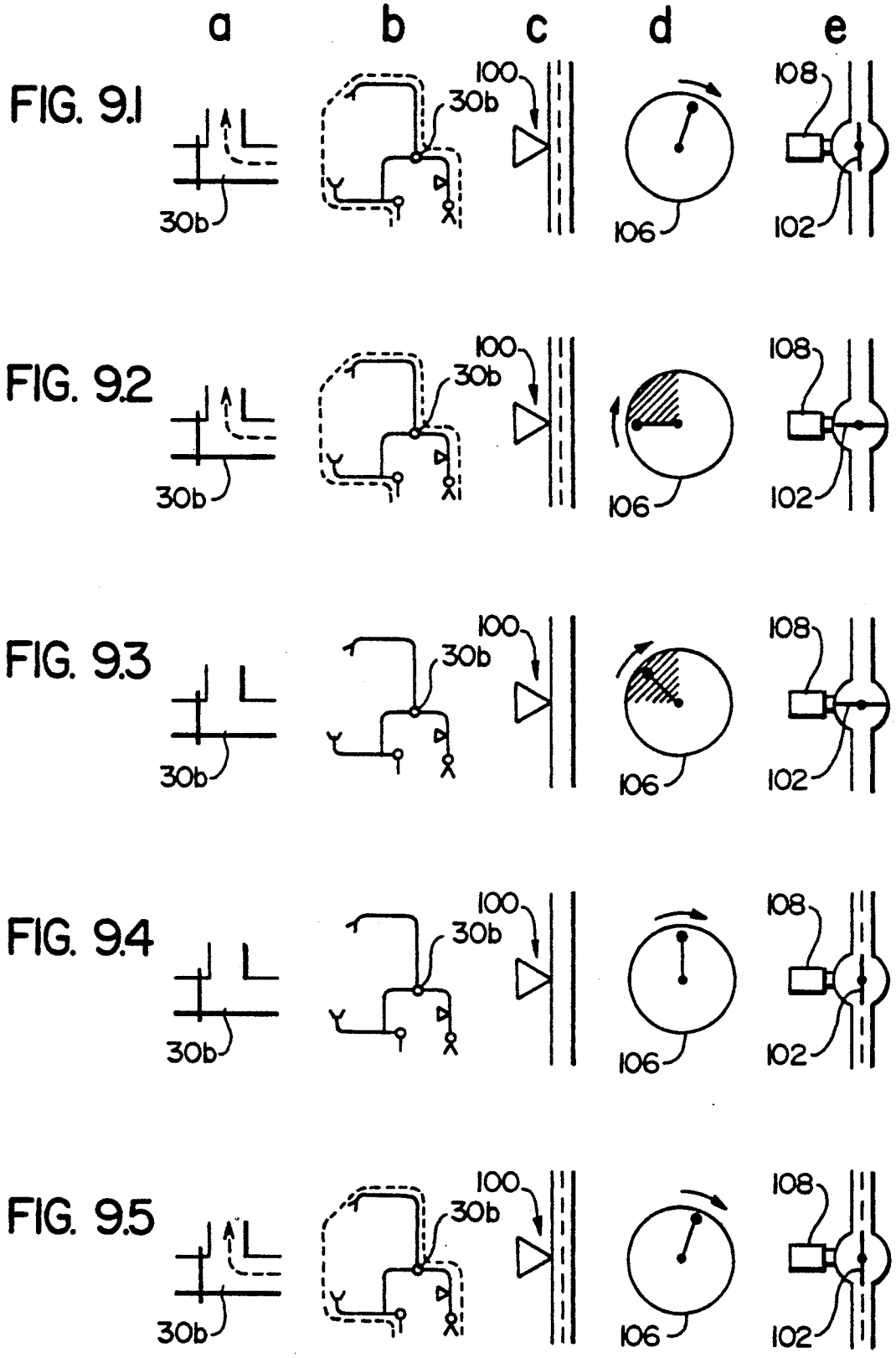
a
b
c
d
e
FIG. 9.1
FIG. 9.2
FIG. 9.3
FIG. 9.4
FIG. 9.5
100
30b
108
106
102

12VDC (REGULATED)
OSCILLATOR/ COUNTER CHIP
INLET GATE VALVE
INLET SWITCH
12VDC
180(371)
12VDC (REG.)
HI PRESS.: OFF
HI PRESS.: ON
+12VDC (REGULATED)
180(212)
12VDC (REG)+
+12VDC(REG.)
ZERO WATER: OFF
POS. WATER: ON
TO FIG. 10B
DRAIN OPERATION SWITCH
PUMP SWITCH
PUMP
DRAIN VALVE
12V DC
180(371)

APPARATUS AND METHOD FOR A WATER-SAVING SHOWER BATH

BACKGROUND OF THE INVENTION

1. Technical Field

The present invention relates generally to shower baths, and more particularly to an automatically controlled shower bath that saves water.

2. Background Art

Shower baths are known wherein water, which is sprayed downwardly on a person, is collected in a basin area, filtered, and then recirculated upwardly to be sprayed on the person again.

A search of the U.S. Patent literature has developed the following patents:

U.S. Pat. No. 3,606,618 (Veech) shows a portable shower bath unit. The major components, as shown in FIGS. 5–6, include a basin 28, a reservoir 86, a pump 88 which is controlled by a pump switch 98, a first valve 118, a second valve 136, and a shower head. Water from the reservoir or the basin may be pumped through the first valve 118 through the shower head. To fill the reservoir, a person must remove a reservoir cap and pour water into the reservoir. To take a shower with reservoir water, the person must position a selector valve 104 which connects the reservoir to the pump as well as positioning the first valve 118 and the second valve 136. The person then depresses the on-off switch 98 to run the pump. To take a shower with recirculated water through the basin, the person must ascertain that the valves 104, 118, 136, and that the switch 98 are in the correct positions for the recirculation mode. Fresh water may be supplied, or alternatively, bath water may be expelled, to an external line 140 which connects through the second valve 136 to the line between the first valve and the shower head. To wash or rinse using water form the external source, the valves 118, 136, and the switch 98 must be in the correct position. To drain water which remains in the drain area, the valves 104, 118 and 136, and the switch 98 are positioned so that the pump moves the water from the drain area through the external hose.

U.S. Pat. No. 4,453,280 (Greenleaf) shows a portable shower in which a pump 40 simply forces water from a tank 17 to the showerhead.

U.S. Pat. No. 4,432,103 (Hunziker) shows a combined shower, steam sauna, and a massage shower in which the water is heated by a heating element. Recirculation of heated water through a pump is shown.

U.S. Pat. No. 4,064,570 (Kim) shows a shower with a dual chamber foot operated pump, wherein one side of the pump forces water from a storage container to the showerhead, and the other forces water from a basin to a waste chamber.

U.S Pat. No. 4,055,863 (Duval) shows a bathing apparatus into which the water is sent heated, and then sprayed onto the prostrate person, and out from which the water is pumped out.

U.S. Pat. No. 3,381,316 (Anderson) shows a shower bath that is connected to a truck wherein water for the shower is heated by the engine of the truck.

U.S. Pat. No. 1,065,265 (Nordmark) shows a shower in which water at the bottom is recirculated to the sprayheads by a foot operated pump.

U.S. Pat. No. 553,046 (Wenger) shows a bathing device that pumps water overhead from where it is sprayed on the person.

U.S. Pat. No. 211,874 (Wasson) shows a shower bath where a person rocks from side to side on a seesaw-like platform which provides pumping action to circulate water.

U.S. Pat. No. 112,217 (Brown) shows a shower bath where water is recirculated by means of a foot pump operated from a pedal.

SUMMARY OF THE INVENTION

The shower system of the present invention is adapted to be operated to receive and deliver fresh water for a washing operation and also to recirculate water through the system for washing. It comprises a showerhead to discharge water to a washing area, a basin to receive the water from the showerhead, a general valve means and a fresh water inlet adapted to be connected to a fresh water source. The system further comprises a waste water outlet leading from the basin and adapted to carry water from the basin to a waste area and a pump means connected to the showerhead and adapted to deliver waste water thereto. In a first preferred embodiment, the general valve means has operative connections to the showerhead, to the basin, to the inlet, and to the waste water outlet. It has three operating positions. In its first operating position a flow connection is made between the fresh water inlet and the showerhead. In its second operating position the flow connection is made from the basin through the pump and to the showerhead, and in its third operating position the flow connection is made from the basin to the waste outlet.

In this first embodiment, the general valve means further comprises a first basin valve means, and a second main valve means. The basin valve means is adapted to direct water of the basin through operative connections to the waste water outlet, or to the showerhead. The main valve means has operative connections that comprise at least an inlet connection to the inlet, an upper connection to the showerhead, and a basin connection to the basin. The main valve means is adapted so that in the second operating position of the general valve means, the basin is able to be connected through the main valve means to the showerhead. In the third operating position of the general valve means, the main valve means connects the inlet connection to the upper connection, but interrupts any flow through the basin connection.

In the first embodiment, the shower system further comprises a water heater means adapted to be thermostatically controlled.

In a second preferred embodiment, the shower system further comprises an overflow control subsystem adapted to sense an inflow of fresh water through the fresh water inlet, and, after the inflow continues beyond a predetermined length of time, to act to cause the first basin valve means to direct water from the basin to the waste water outlet. The shower system further comprises a waste water control subsystem. This subsystem acts automatically to cause the first basin valve means in the second position of the general valve means to direct water of the basin to the showerhead. In the third position of the general valve means, this waste water control subsystem acts to cause the first basin valve means to direct the water of the basin to the waste water outlet.

In a third preferred embodiment, the shower system further comprises a consumption control subsystem. The consumption control subsystem in turn comprises an inlet valve means, which is adapted to allow or interrupt an inflow of water between the fresh water inlet and the washing area, and a consumption control means. The consumption control means is adapted to sense the inflow and to act to cause the inlet valve means to interrupt the inflow during portions of control cycles, which the inlet valve means undergoes, and in which the inflow is alternately interrupted for a second predetermined length of time and allowed to flow for a third predetermined length of time, as long as fresh water is demanded by the shower system.

In the third embodiment, the consumption control subsystem further comprises timer means and pressure sensing means which senses water pressure between the inlet valve means and the second main valve means. The consumption control means causes the inlet valve means to allow the inflow or to undergo the control cycles, respectively, depending on whether the pressure sensing means senses water pressure that is above or below, respectively, a predetermined level of pressure. There is provided in the consumption control means an AND gate means. The AND gate means responds to stimuli from the pressure sensing means and the timer by acting to cause the inlet valve means to interrupt the inflow.

In the third embodiment, the control circuit of the present invention has other operative connections to the pump means, to the waste water valve means, and to a water sensing means which senses the flow of water in the shower system. The pump means, the consumption control system, and the waste water valve means are actuated by the flow of water in the shower system as sensed by the water sensing means.

A method of the present invention comprises several steps. The fresh water inlet, the waste water outlet, and the pump are provided. Water is discharged from the showerhead to the washing area and is received from the showerhead in the basin. The general valve means is provided having the first, second, and third operating positions. It includes the first basin valve and the second main valve, with the main valve adapted in the second operating position to connect the basin to the showerhead. Overflow control and water consumption control are both provided.

BRIEF DESCRIPTION OF THE DRAWINGS

FIGS. 4.1(*a* and *b*) through 4.4(*a* and *b*) are a series of schematic diagrams in rows showing the general operation of the first embodiment, and more particularly, the status at progressive stages of operation of the main valve under column A, and of the overall plumbing under column B;

FIGS. 6.1(*a, b, c, d* and *e*) through 6.4(*a, b , c, d* and *e*) are a series of schematic diagrams illustrating the water consumption control system of the third embodiment at progressive stages, and more specifically, the main valve under column A, the plumbing under column B, the inlet pressure sensor under column C, the timer under column D, and the inlet gate valve which controls the inflow of fresh water under column E;

FIGS. 7.1(*a, b, c, d* and *e*) through 7.5(*a, b, c, d* and *e*), FIGS. 8.1(*a, b, c, d* and *e*) through 8.3(*a, b, c, d* and *e*) and FIGS. 9.1(*a, b, c, d* and *e*) through 9.5(*a, b, c, d* and *e*) respectively, are diagrams like FIG. 6, but showing the operation when the inflow of fresh water is allowed to run, respectively, for an indefinite time in the fill mode, for only 40 seconds in the wash mode, and finally, for an indefinite time in the wash mode;

DESCRIPTION OF THE PREFERRED EMBODIMENTS

It is believed that a better understanding of the present invention will be provided by first describing a conventional shower stall. Next, the main operating modes of a basic inventive embodiment will be identified and described. This will then be followed by a description of several refined embodiments and further technical details of the invention.

1. A Conventional Shower Stall.

Figure 1:
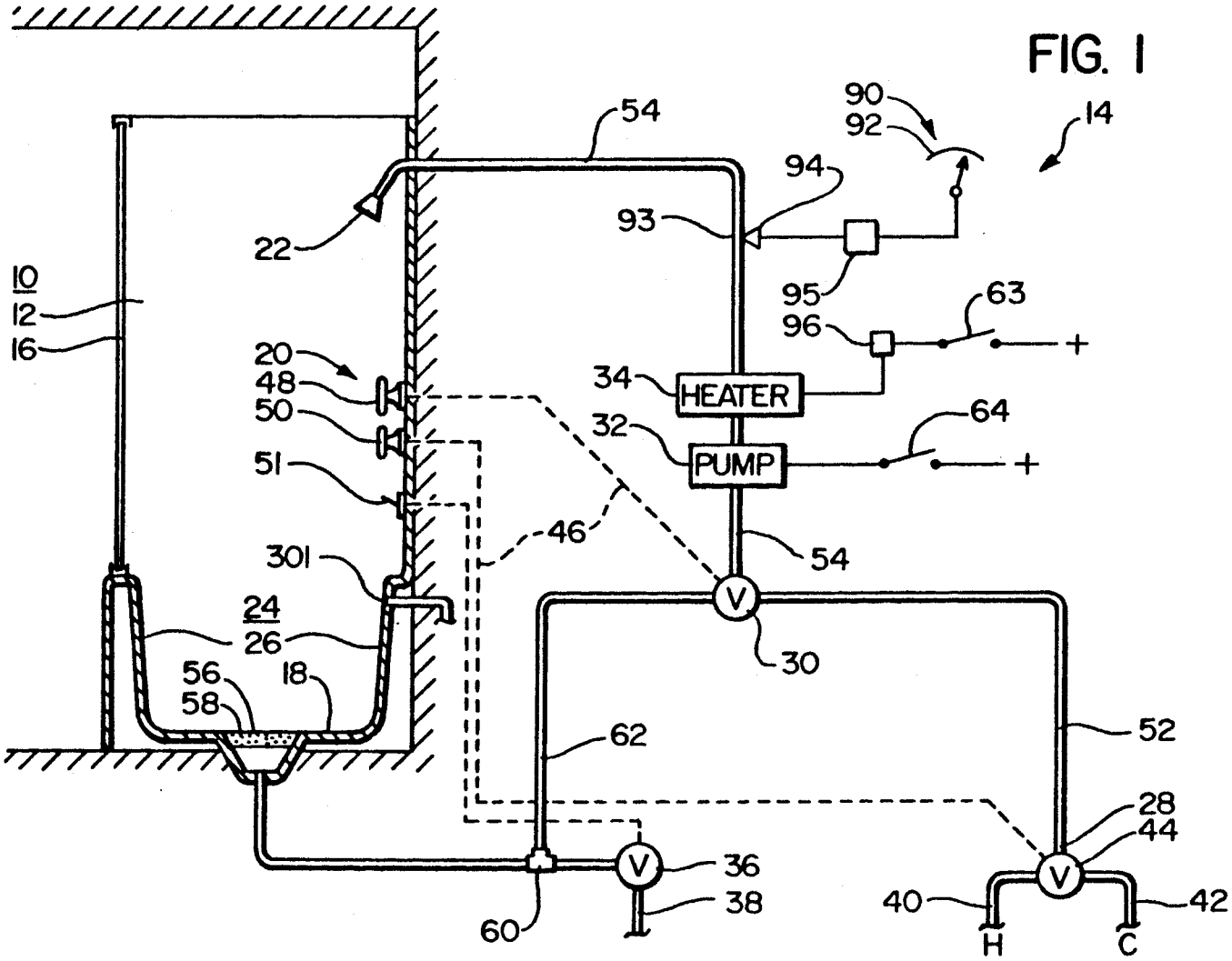
FIG. 1 is a schematic diagram of the first embodiment of the shower system of the present invention.

FIG. 1 illustrates a bathroom area 10 comprising a conventional shower stall 12 (fitted with a basic embodiment of a shower system of the present invention pictured schematically and generally designated 14 to be set forth in Section 2.) Through a shower door 16 a person is able to enter the shower stall, where the person stands on a shower floor 18 and is able to operate the shower apparatus by turning control knobs 20, a shower bath being sprayed from an upper location through a shower head 22 onto the person. The water falls to a basin 24, which is formed of the shower floor 18 and of basin walls 26 and which receives the water.

2. A Basic Inventive Embodiment of a Shower System With Its Operating Modes.

a. The components. The major components of the shower system 14 of the present invention in addition to the shower head 22 and basin already introduced, are a fresh water inlet shown at 28, a main valve 30, a motor-driven pump 32, a water heater 34, a drain valve 36, and a waste water outlet 38.

To supply water at the fresh water inlet location 28, there are hot and cold water pipes 40 and 42 joined to a hot and cold water mixing valve 44 which provides an output of selectively blended hot and cold water for intake into the shower system 14. This valve 44 is always open. As indicated by dotted lines 46 the main valve and the hot and cold water mixing valve are each controlled manually by a main control knob 48 and by a mixing control knob 50, respectively, that are able to be reached by the person from within the shower stall. The drain valve 36 is also manually operable from the shower stall by means of a lever 51.

There are provided flow connections as follows: (i) from the fresh water inlet location 28, through a right pipe 52, into a body of the main valve 30; (ii) from the main valve 30 upwardly, through an upper pipe 54, out through the shower head 22; and (iii) from the basin 24 downwardly, through a drain area 56 where there is a water filter 58, through a T-connection 60, and (if the drain valve 36 is in a closed position) upwardly into a left pipe 62, into the body of the main valve 30, or (if the drain valve 36 is open rather than closed) downwardly through the drain valve 36 and out the waste water outlet 38.

The main valve 30 connects together selectively the right, upper, and left pipes 52, 54 and 62, the main valve having three operating positions, namely a fill, wash, and rinse positions that will be described presently. The main valve also has a fourth closed position in which the main valve blocks any flow between the pipes.

Reference is made to the schematic diagrams of FIG. 4 in which column a shows the status of the main valve 30, and column b illustrates, by means of dashed lines 62', the path of the water through the shower system 14. The drain valve 36 has closed or open positions represented by the presence or absence, respectively, of the double horizontal lines. In the fill position as shown in row 4.1 of the diagrams the main valve 30 joins all three pipes namely, the right, upper, and left pipes 52, 54, and 62, together. Water from the fresh water inlet location 28 flows through the right pipe 52 leftwardly into the main valve 30 where the water is divided by the main valve 30, one part of the water being directed into the upper pipe 54 upwardly where the water continues through the shower head 22, into the basin 24, and the other part of the water being directed by the main valve 30 into the left pipe 62 leftwardly where the water continues through the T-connection 60, and (provided the drain valve 36 is closed) from underneath into the basin 24.

In the wash or recirculating position as pictured in row 4.2 the main valve 30 blocks off the right pipe 52, while interconnecting the upper pipe 54 and the left pipe 62. Water from the basin 24 flows through the T-connection 60, and (provided again, that the drain valve 36 is closed) through the left pipe 62 rightwardly into the main valve 30, which blocks any flow into the right pipe and which directs all of the water into the upper pipe 54 upwardly, where the water continues to the shower head 22.

In the rinse position as shown in row 4.3 the main valve 30 blocks off the left pipe 62, while joining together the right pipe 52 and the upper pipe 54. Water from the fresh water inlet location 28 once again flows through the right pipe 52 leftwardly into the main valve 30, which blocks any flow into the left pipe and which directs all of the water into the upper pipe 54 upwardly, where the water continues through the shower head 22 into the basin 24. For this first embodiment, the drain valve is pictured as closed in the rinse mode. As will be brought out in the second embodiment, in many cases it is often more desirable to have the drain valve open in the rinse mode and the rinse mode will function either way.

As illustrated in row 4.4, the main valve 30 in its closed position blocks any flow between the pipes 52, 54, and 62, as mentioned, so that water flow in the system is stopped.

b. The Three Modes of Operation. Corresponding to the three operating positions of the main valve 30, the shower system 14 of the invention has three modes of operation, namely, fill, wash, and rinse modes, which will now be reviewed.

In order to begin the fill mode, the person (a) checks that the drain valve 36 is in its closed position; (b) moves the main valve 30 from its closed position to its fill position of row 4.1; and (c) turns on the heater 34 and the pump 32 with manual on/off switches 63 and 64, respectively, which are located on the wall in the bathroom area 10. As just described the main valve 30 in this position will connect the right pipe 52 to both the upper pipe 54 and the left pipe. The hot and cold water mixing valve 44 normally will be preset from the last shower so that there will already be the proper proportioning of the hot and cold water supplied by the hot and cold water pipes 40 and 42. If not, the person is able to run the water for a short while with the drain open until the person senses that the mixture is comfortable. The mixing valve 44 is able to be simply left in the desired position for subsequent showers. The moving of the main valve 30 to its fill position will direct one part of the water from the fresh water inlet location 28 into the upper pipe 54 upwardly, where the water will continue out the shower head 22 from where the water will fall to fill the basin 24. This will also direct the other part of the fresh water into the left pipe 62 leftwardly, where the water will continue through the T-connection 60 upwardly through the drain area 56 into the basin 24. The basin 24 will be filled simultaneously from both the drain area 56 underneath and the shower head 22 above. Suitable overflow check means, such as an overflow duct, prevents accumulated water from overflowing the basin 24 and running onto the outside floor.

Once that the person has sensed that there is sufficient water in the shower system (perhaps half a gallon) with which to begin washing, the person will turn the main valve 30 from its fill position to its wash position (shown in row 4.2), where as described above the main valve 30 connects the left pipe 62 to the upper pipe 54. The pump 32 will pump the water through the system, and consequently, the water will recirculate.

More particularly, the water will be pumped from the pump 32 upwardly out the shower head 22 from where the water will be sprayed on the person, who will wash. Then the water will be collected in the basin 24 where the water will be directed through the drain area 56 downwardly through the T-connection 60 upwardly through the left pipe 62 through the main valve 30 where the water will be directed into the upper pipe 54 upwardly into the pump 32 where the water will again be pumped in the recirculating pattern.

When the person desires to rinse, the person will turn the main valve 30 to its rinse position (row 4.3), where as mentioned above, the main valve 30 connects the right pipe 52 to the upper pipe 54. The blended hot and cold water from the fresh water inlet location 28 will then be sent into the main valve 30 where the water will be directed into the upper pipe 54 upwardly, out the shower head 22 where the water will be sprayed onto the person who will rinse. The water will then fall to the basin 24 where the water will be collected.

After the person is finished rinsing, the person will turn off the pump 32 and the heater 34 and then, as shown in row 4.4, move the main valve 30 to its closed position, which will block any input of water into the system. At the end of the shower bath the person will open the drain valve 36 to let the water of the system drain out. The heater 34 is thermostatically controlled by a thermostat system to be described later which maintains the water at a comfortable temperature for as long as the person is using the shower and which prevents the water from getting too hot.

To summarize, the modes just described enable (i) the shower system to be filled with the blended hot and cold fresh water, (ii) the person to be bathed using the recirculated water, and (iii) the person afterwards to be rinsed with fresh water. The two modes in which fresh water is demanded are the fill and rinse modes (rows 4.1 and 4.3) while the one mode that operates without fresh water is the wash or recirculating mode (row 4.2) In the wash mode each time that the recirculated water passes through the water filter 58 and through the water heater 34, respectively, the water is filtered and is heated to a temperature comfortable for washing.

3. A Second Embodiment, Including An Automatic Drain.

Figure 2:
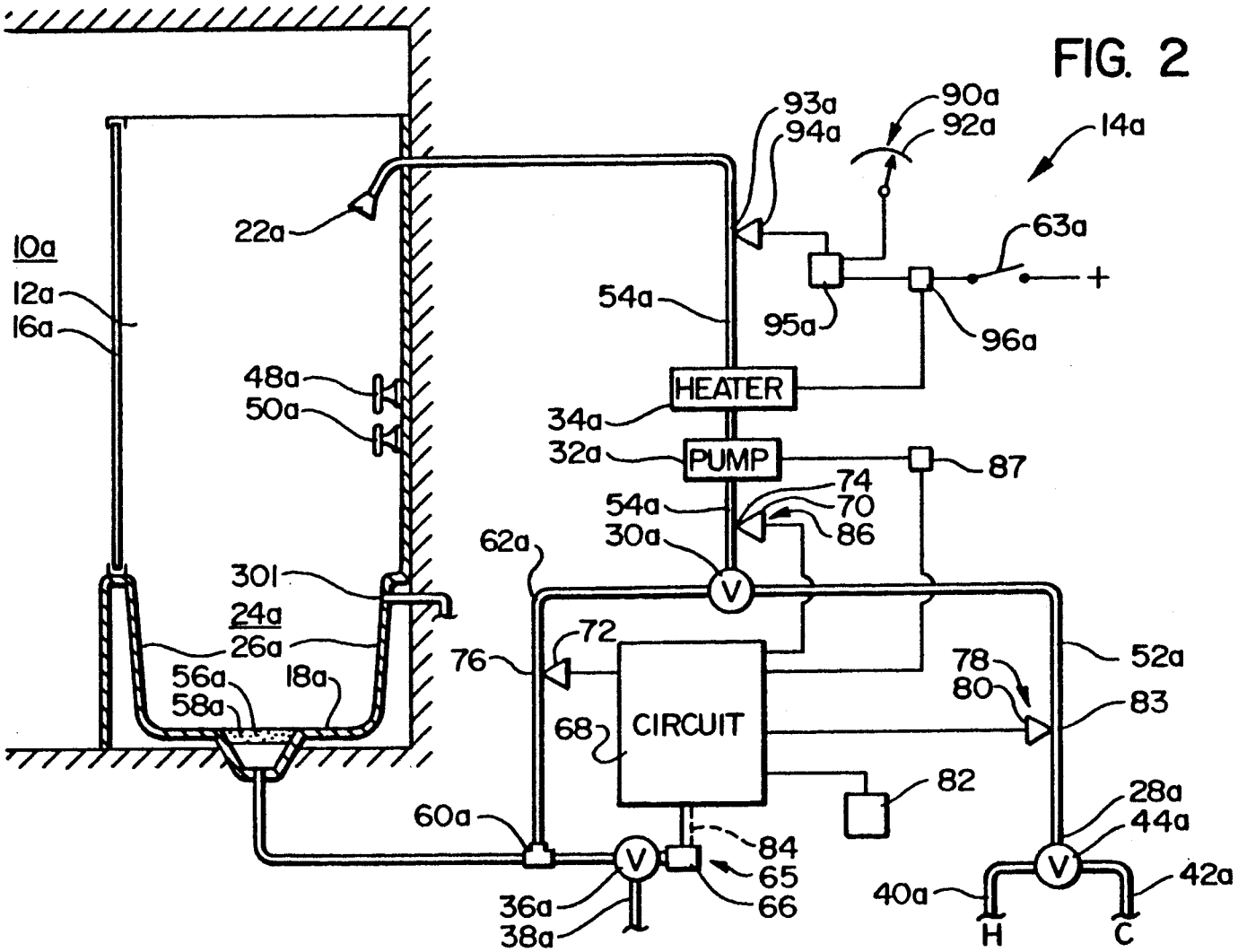
FIG. 2 is a view like FIG. 1 but of the second embodiment.

In addition to the components of the entire system just described in Section 2, a second embodiment shown schematically in FIG. 2 has an automatic drain and some other technical features to be described presently. In explaining the second embodiment, components which are like those of the first embodiment will have the same numbers with the letter "a" added. The paragraphs of this section will first describe steps accomplished by an automatic drain control subsystem 65 of the invention. An operational description will then follow of the drain control and other automatic features.

a. The Steps Accomplished by the Drain Control. In the fill mode (in which as described above fresh water from the location **28*a* is directed through the main valve 30*a* both leftwardly through the left pipe 62*a* into the basin 24*a*, and upwardly, through the upper pipe 54*a* out through the shower head 22*a* into the basin 24*a*) the drain valve 36*a* needs to be positioned in its closed position. In the wash mode, where as previously explained the water recirculates from the pump 32*a*, out through the shower head 22*a*, into the basin 24*a*, upwardly, through the left pipe 62*a*, through the main valve 30*a*, and back through the pump 32*a*, the drain valve 36*a*** also needs to be positioned in its closed position, to keep a closed flow circuit.

In the rinse mode, in which as explained the water from the fresh water inlet location **28*a*, is directed by the main valve 30*a* upwardly, through the upper pipe 54*a*, out through the shower head 22*a* and into the basin 24*a*, it may be desirable under many circumstances to have the drain valve 36*a* in its open position, so that the water continues immediately through the basin 24*a*, through the drain valve 36*a*, and out the waste water outlet 28*a*. When, after completion of the rinse mode, the person moves the main valve from its rinse position to its closed position, thereby stopping any flow of water into the shower system, the drain valve 36*a*** needs to remain open so that all the water is drained out of the system.

The drain control subsystem 65 automatically opens or closes the drain valve **36*a*** according to these objectives.

b. Components and Operation of The Drain Control. The main components of the drain control subsystem 65 include the drain valve **36*a*, controlled by a drain solenoid 66, a general control circuit 68, and upper and left water sensors or switches 70 and 72**, respectively.

The upper water sensor 70 is a sensor preferably adapted to sense any upward movement or flow of water at a sensing location 74 in the upper pipe while the left water sensor 72 is adapted to sense movement, whether downward or upward, at a sensing location 76 in the left pipe. (Alternatively, the water sensors 70 and 72 are able to be water presence sensors such as optical sensors using a beam that is interrupted by water; but flow sensors function more accurately for the functions described presently.) Responsive to the sensed water conditions, the water sensors 70 and 72 will send signals to the control circuit 68 which will selectively energize or de-energize the drain solenoid 66 so as to close or open the drain valve **36*a*. For example, in the wash mode, when the water recirculates from the basin 24*a* through the main valve 30*a* upwardly out the shower head 22*a*, both the left and upper water sensors 72 and 70** sense the flow.

The control circuit 68 is adapted to cause the drain valve 36 to close only when the upper and left water sensors 70 and 72 sense water flow at both the upper and left sensing locations 74 and 76. Otherwise, the drain valve **36*a*** is caused to open.

In operation of the drain control subsystem 65, before the shower system is used, i.e., when the main valve **30*a* is in its closed position, the drain valve 36*a* will be open, because both water sensors 70 and 72 will sense zero water flow. When the person moves the main valve 30*a* to its fill position, which will cause water from the fresh water inlet location 28*a* to flow (in the manner previously discussed in row 4.1 of FIG. 4) both upwardly through the upper pipe 54*a* out the shower head 22*a* and leftwardly through the left pipe 62*a*, both the upper water sensor 70 and the left water sensor 72 (of FIG. 2) will sense the water flow, which will cause the control circuit 68 to act to close the drain valve 36*a*. When the person shifts the main valve 30*a* to its wash position making the water recirculate (as in row 4.2 of FIG. 4) from the basin 24*a*, to the main valve 30*a*, out the shower head 22*a* and back to the basin 24*a*, the left water sensor 72 and the upper water sensor 70 will again both sense the water flow, which will cause the general control circuit 68 to act to keep the drain valve 36*a*** closed.

When the person moves the main valve **30*a* to its rinse position directing water (as shown in row 4.3 of FIG. 4) from the fresh water inlet location 28*a* upwardly through the upper pipe 54*a* and out the shower head 22*a*, the upper water sensor 70 of FIG. 2 will sense water flow while the left flow sensor 72 will sense zero water flow. Since in this case one of the flow sensors will sense zero flow, the control circuit 68 will open the drain valve 36*a* so that the water from the shower head that will have fallen into the basin 24*a* will then be allowed to drain through the drain valve 36*a* out the waste water outlet 38*a*. Finally, when the main valve is moved to its closed position, neither the upper sensor nor the left sensor will sense water flow, and the drain valve 36*a*** will be caused to remain in its open position.

In short, during the fill and the wash modes, the drain valve **36*a* is automatically closed, which keeps the water in the shower system, while in the rinse mode the drain valve 36a** is automatically open, which allows water to exit from the system.

b. Other Automatic Features. Other automatic features included in the second embodiment of FIG. 2 include overflow monitoring, pump control, and thermostatic control.

To first introduce the objective of the overflow monitoring function, initially, when the main valve 30a has been placed in its fill position (as in row 4.1 of FIG. 4), so that the water from the fresh water inlet location 28a is filling the basin 24a both from the shower head 22a above and from the drain area 56a underneath, the drain valve 36a of FIG. 2 is normally closed, because as just described above both of the sensors 70 and 72 will sense water flow. In the event that the water is left on for too long a period of time in this fill mode, it is highly desirable to open immediately the drain valve 36a in order to let the water escape through the waste water outlet 38a.

In order to monitor this overflow situation, an overflow monitoring sub-system 78 is provided. The overflow monitoring sub-system 78 comprises an inflow sensor 80 and a timer 82 both of which are operatively connected to the general control circuit 68. The inflow sensor 80 senses flow in the right pipe 52a at an inlet sensing location 83 which is between the fresh water inlet location 28a and the main valve 30a, the sensor 80 being able to sense whenever there is an inflow of water into the shower system. Responsive to the inflow sensor 80 the timer 82 times the inflow. If the inflow continues for longer than a predetermined time period where an inflow cutoff is warranted, as for example one minute, the timer 82 sends a cutoff signal to the general control circuit 68, which in turn, as indicated by a dotted line 84, acts to open the drain valve 36a.

Reviewing the operation of the overflow monitoring subsystem 78, when the main valve 30a has been put in its fill position, the inflow of fresh water into the shower system will begin to fill the basin 24a. If the person is inattentive or otherwise is unable after the predetermined time has elapsed to switch the main valve 30a from its fill mode to its wash mode, the timer 82 will recognize that a risk of overflow exists because the inflow has been left on for too long, and will act to open the drain valve 36a to remedy the situation.

To describe a pump control feature, whenever water is to be lifted from below up to the shower head 22a the pump 32a must be turned on. Pumping is desirable normally in the operating modes, that is, in the fill, wash, or rinse modes, and is unnecessary when the shower system is off. To turn the pump on and off, there is employed a pump control sub-system 86 comprising a pump switch 87, incorporated in the general control circuit 68, and the upper water sensor 70 which is connected to the general control circuit 68. As mentioned above, the upper water sensor 70 senses upward flow in the upper pipe 54a at the upper sensing location 74 between the main valve 30a and the pump 32a. In any of the operating modes as shown in rows 4.1, 4.2, and 4.3 of FIG. 4, there will be an upward flow in the upper pipe 54a and the upper water sensor 70 will sense this upward flow. It is only when the main valve 30a is closed as in row 4.4 (that is, when the shower system is off before or after use) that the upper water sensor 70 will sense zero upward flow. The general control circuit 68 is arranged so that, responsive to the upper water sensor 70, whenever there is water flow at the upper sensing location 74, the general control circuit acts through the pump on-off switch 87 to turn on the pump 32a. In the fill mode, when the water flows both into the pump 32a through the upper pipe 54a and into the left pipe 62a, in the wash mode, when the water recirculates from the basin 24a upwardly through the upper pipe 54a through the pump 32a to the shower head 22a, and in the rinse mode, where the water from the fresh water inlet location 28a flows through the main valve 30a upwardly through the pump 32a and out the shower head, the pump 22a will be kept on. When the main valve 30a is turned to its closed position, the inflow of water will cease which will cause the general control circuit 68 to shut off the pump.

Thermostatic control of the heater is provided in both the first and second embodiments.

A thermostatic control sub-system 90, 90a that (i) responds to a temperature setting of a manually operated temperature setting switch or potentiometer 92, 92a, (ii) monitors a temperature of the water flowing through the upper pipe 54, 54a at a temperature setting location 93, 93a as determined by a water temperature sensor or thermistor 94, 94a, and (iii) using a thermostatic subcircuit 95, 95a of the control circuit to compare input signals from the potentiometer 92, 92a and the temperature sensor 94, 94a and acting through a heater power switch 96, 96a, turns the water heater 34, 34a on and off automatically, so as to maintain the water temperature of the shower system at, or close to, the manual temperature setting.

4. A Third Embodiment having a Water Consumption Control Means.

Figure 3:
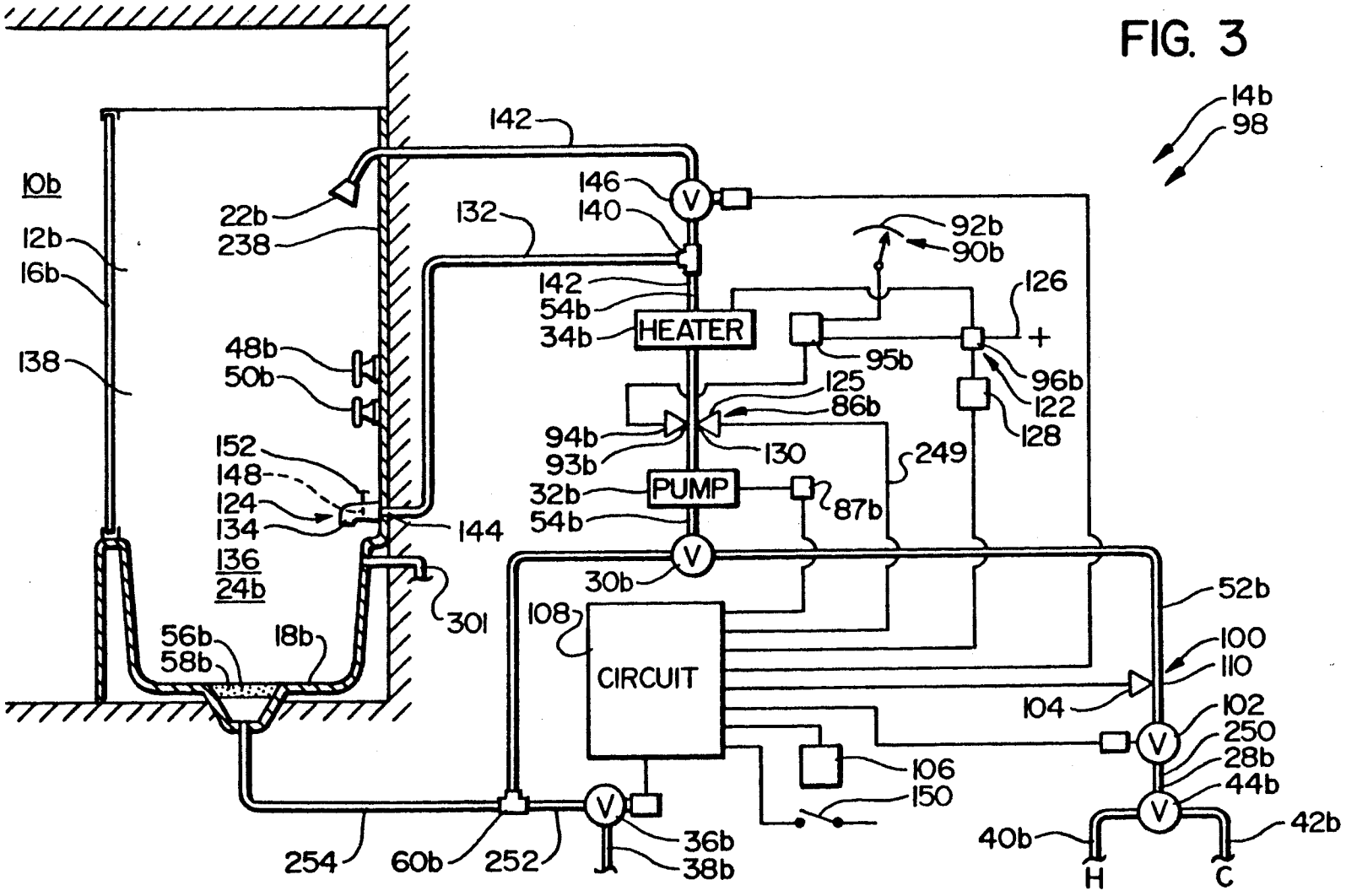
FIG. 3 is a view like FIGS. 1 and 2, but of the third embodiment.
Figure 5A:
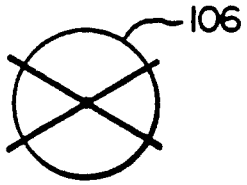
FIGS. 5*a* through 5*g* are a diagram that introduces a timer of the water consumption control system of the third embodiment, the timer being schematically represented at progressive stages by a series of clock faces.
Figure 5B:
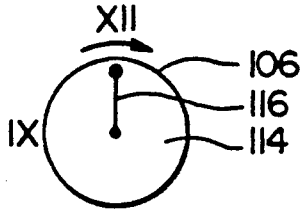
Figure 5C:
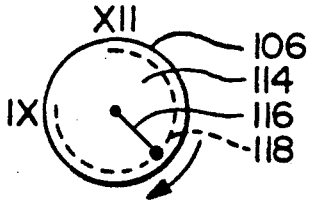
Figure 5D:
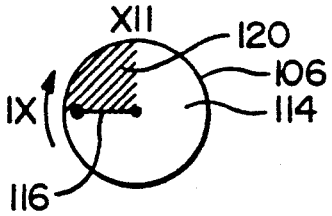
Figure 5E:
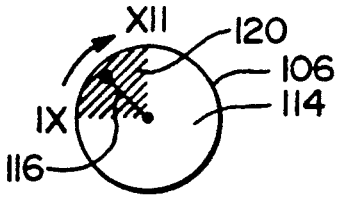
Figure 5F:
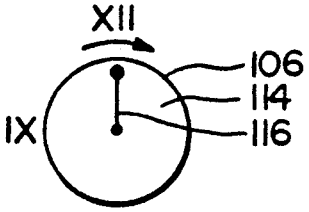
Figure 5G:
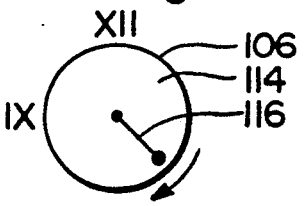

In FIG. 3 there is shown a third embodiment 98 of a shower system in which components that are like those of the previous embodiments will have the same numbers but with the letter "b" as a suffix. Like the earlier embodiments, the third embodiment comprises all the main components of the basic embodiment 14 of FIG. 1 (including the main valve 30b which is able to assume the fill, wash, rinse, and closed positions) and still has the three main modes of operation, namely, the fill, wash, and rinse modes. Unlike the previously described embodiments, the third embodiment 98 additionally comprises a water consumption control subsystem 100 and some other control features. The remainder of this section is organized in two parts: a first part that will describe the components and operation of the consumption control subsystem 100, and a second part that will describe the other control features.

a. The Water Consumption Control Subsystem 100. As previously explained, the two modes in which fresh water is demanded are the fill (shown in row 4.1 of FIG. 4) and rinse modes (row 4.3), while the wash mode is the one operating mode that operates without demanding fresh water. Whenever the main valve 30b is positioned in the fill or rinse positions, the consumption control subsystem 100 of FIG. 3 is adapted to undergo control cycles automatically. Each such control cycle comprises: (i) permitting the inflow of the fresh water from the inlet location 28b into the shower system for a first predetermined length of time, say 45 seconds; and (ii) cutting off the inflow to produce a hiatus of zero inflow for a second predetermined length of time, such as for example 15 seconds. If the main valve 30b is left on indefinitely in either of the fill or rinse positions, the consumption control subsystem will simply keep on repeating the control cycles. In other words, the consumption control subsystem will allow the inflow for the first length of time, will then stop the inflow so as to create the hiatus, will again allow the fresh water to flow for the first length of time, will stop the inflow again, repeating the hiatus, and so on.

The hiatus indicates to the person who is using the shower that the person has demanded fresh water for too long a period of time. As previously discussed, the person has the ability at any time to shift the main valve **30*b* to the wash position (row 4.2) or to the off position (row 4.4), in both of which zero water is demanded. The repetitions of hiatus in effect provide for the person an incentive or reminder to shift from the fill mode to the wash mode (or from the rinse mode to the off mode) so that the overall consumption of fresh water is reduced. The object of the water consumption control subsystem 100** is to produce these hiatuses during the fill and rinse modes.

The water consumption control subsystem 100 comprises a solenoid controlled inlet gate valve 102, an inlet pressure switch or pressure sensor 104, a timer 106, and a general control circuit 108 (which is different from the general control circuit introduced earlier in connection with the second embodiment.) The inlet gate valve responsive to the control circuit 108 is opened to permit inflow into the right pipe **52*b* or closed to stop the inflow. The inlet pressure sensor 104 senses water pressure at an inlet sensing location 110** in the right pipe.

It will be helpful first to describe the inlet pressure sensor 104, and then to review how the timer 100, which is an elementary on/off timer, works. To describe the pressure sensor 104, it is first to be noted that when the main valve **30*b* is in its wash or closed position there is relatively high pressure at the inlet sensing location 110 because of the external pressure exerted at the inlet by the water supply means. When the main valve is in its fill or rinse position, there is normally low pressure at the inlet sensing location 110 because the water is then moving (i.e. low pressure results from the Bernouilli principle). In effect, high pressure indicates a zero flow condition, while low pressure normally indicates a positive inflow from the inlet. Responsive to these conditions, the inlet pressure sensor 104 generates either a high pressure or low pressure signal, which the inlet pressure sensor sends to the control circuit 108**.

To explain the timer 106, the timer of course is adapted when low pressure is sensed, to cause the valve 102 to undergo the previously described timed control cycles, wherein the valve is alternately open and closed. The timer may be thought of, as shown in several schematic clock faces, of FIG. 5, as a circular face 114 of a clock having a single rotatable hand 116. More likely than not the control circuit 108 will be in a flow allowing condition, because the control circuit is in its flow allowing condition when either one of two prerequisites is satisfied: (i) the timer 106 although running is disabled or overridden as represented in clock face c of FIG. 5 by the clockface being covered with an "x", or, (ii) the timer is both in an enabled control mode, (represented in clock faces b–g of FIG. 5 by the hand 116 rotating clockwise), a–g is in a flow allowing region which the timer traverses in its control mode. The situation where the timer traverses its flow allowing region is represented by the hand 116 traversing a three/quarters arc 118 of the circular face 114 between twelve o'clock and nine o'clock. (See, particularly clock face c in which the arc 118 is indicated as a dashed arc). The only situation in which the timer 106 will regularly be found in a flow stopping condition is when the timer in its control mode moves into a flow stopping region. This is represented in clock faces d and e by the hand 116 moving into a one/quarter arc 120 indicated by the shading between nine o'clock and twelve o'clock. Responsive to the high pressure or low pressure signals, respectively, from the inlet pressure sensor mentioned above the timer is either disabled or put into its cyclically alternating control mode, respectively. The timer 106 is able to traverse its flow allowing region in the first predetermined time and its flow stopping region in the second predetermined of time. The timer is arranged so that regularly it begins its control mode at the beginning of the flow allowing region (i.e. the hand regularly starts its rotation, as in clock face b, at the twelve o'clock position), and in its control mode it advances at, of course, a constant rate. If the timer is left on in its control mode indefinitely, it simply alternates with advancing time between the flow allowing region and the flow stopping region.

To recapitulate the discussion so far while referring again to FIG. 3, if there is high pressure sensed at the inlet sensing location 110, the inlet pressure sensor 104 sends the high pressure signal via the control circuit 108 which disables the running timer 106. The control circuit allows or causes the inlet gate valve 102 to remain open. However, if low pressure is sensed by the inlet flow sensor 104, that is, if there is fresh water flowing at the sensing location, the inlet pressure sensor 104 sends the low pressure signal via the control circuit 108 to the timer 106, which is thereby put into its control mode. In its control mode, the timer begins to traverse its flow allowing region starting at zero time, and the control circuit 108, sensing that the timer is in its flow allowing condition, causes the inlet gate valve 102 to remain open. After the end of the first predetermined length of time, e.g. 45 seconds, if there is no change in pressure the timer enters its flow stopping region, and the control circuit 108 sensing that the timer is in its flow stopping condition, causes the inlet gate valve 102 to close, thereby producing the desired hiatus of inflow.

Let us examine now how operation of the consumption control subsystem 100 relates to the person's using (as previously set forth in Section 2) the shower system. FIG. 6 is a series of schematic diagrams showing the status of the following components: in column a, the main valve; in column b, the plumbing of the shower system; in column c, an enlarged view of the right pipe **52*b* with the inlet sensing location 110; in column d, the timer 106; and in column e, an enlarged view of the inlet gate valve 102 in the right pipe 52*b***.

In row 6.1 of FIG. 6 there is initially shown an off mode of the shower system, in which the main valve **30*b* is closed; there is zero water flow in the shower system; the timer 106, responsive to the resulting high pressure signal being put out by the inlet pressure sensor 104, is disabled in its flow allowing disabled mode; and the inlet gate valve 102, responsive to the control circuit 108 sensing this flow allowing condition, is initially open. Assuming now as shown in row 6.2 that the person using the shower turns the main valve 30*b* to its fill position (in which, as earlier described, the right inlet pipe 52*b* is connected to both the upper pipe 54*b* and the left pipe 62*b*) the shower system will demand fresh water and the inlet pressure sensor 104 will sense low pressure at the sensing location 110. The sensor 104 will put out the low pressure signal, which will cause the timer 106 to shift to its control mode, with the timer beginning to traverse its flow allowing region starting at zero time (i.e., schematically shown as 12:00 o'clock). In response to this, the control circuit 108 will cause the inlet gate valve 102** to remain open. Assuming further as shown in row 6.3 that at some time before the timer 106 finishes traversing its flow allowing region, e.g. at 40 seconds of elapsed time, the person shifts, as shown in row 6.4, the main valve 30*b* to its wash position (in which, as initially set forth, the main valve 30*b* connects only the left pipe 62*b* to the upper pipe 54*b*, causing the water to recirculate) the shower system will demand zero inflow which will result in high pressure being sensed by the inlet flow sensor 104, which will act to override the timer 106 so that the timer although running will be in its flow-allowing disabled mode, and, through the operation of the control circuit 108, to keep the inlet gate valve 102 open. During the whole sequence of FIG. 6, the inlet gate valve 102 has remained open.

Let it be supposed instead as shown in a new sequence of diagrams in FIG. 7, that, after the main valve 30*b* has been put in its fill position (as shown in row 7.1) which causes the water to begin flowing and the timer 106 to start traversing its flow allowing region, the main valve 30*b* is left in its fill position indefinitely as occurs if the person is paying minimal attention. When the timer 106 reaches its flow stopping region, e.g. after the 45 seconds has elapsed as shown in row 7.2, the control circuit 108 senses this and causes the inlet gate valve 102, to close and the water flow into the shower system to stop. During the time that the timer 106 will traverse its flow stopping region, the control circuit 108 will act as shown in row 7.3 to keep the inlet gate valve 102 closed. Responsive to the timer 106 again reaching its flow allowing region as shown in row 7.4, Col. d, the control circuit 108 will act to open the inlet gate valve 102 so as again to allow the inflow past the inlet gate valve into the system as shown in row 7.5. Repeating the control cycle, the timer 106 will advance and the consumption control subsystem 100 will continually alternate to turn the water on and off (Eventually the water will fill up to the level of the overflow duct and then will drain through the duct.)

If, after the standard wash mode (in which as described in Section 2 the water recirculates through the shower system) the main valve 30*b* is turned to its rinse position, then the consumption control subsystem 100 operates just as described in connection with the main valve 30*b* being in its fill position.

More particularly as shown in FIG. 8 with the main valve 30*b* placed initially in its rinse position, if, before the first predetermined length of time has expired, the main valve 30*b* is shifted to its closed position (shown in row 8.3), the timer 106 will continuously be either in its flow allowing condition or overridden, and the consumption control subsystem 100 will continually keep the inlet gate valve 102 open.

If instead as shown in FIG. 9, after the main valve 30*b* has been placed in its rinse position it is left there indefinitely, the timer 106 (shown in rows 9.1 and 9.2) completing the advance through its flow allowing region will traverse (as shown in rows 9.3 and 9.4) its flow stopping region during which time the control circuit 108 will act to close the inlet gate valve 102 thereby shutting off the flow of fresh water into the shower system. When the timer 106 (shown in row 9.4) reaches its flow allowing region, a new cycle will begin as shown in row 9.5 with the control cycles being repeated thereafter indefinitely.

As earlier mentioned, the fact that the fresh water turns off automatically indicates to the person that too much fresh water has been used. Normally, the person will respond to this indication (if as shown in FIG. 7, row 7.2, the main valve 30*b* is in its fill position) by moving the main valve 30*b* as shown in row 6.4 to its wash position thereby starting the wash mode, or (if as shown in FIG. 9, row 9.2 the main valve 30*b* is in its rinse position) by shifting the main valve 30*b* as shown in row 8.3 to its closed position thereby ending the shower bath. In both cases, however, the person is free simply to wait out the hiatus of the water flow until a new control cycle begins and the water flow recommences as shown in rows 7.5 and 9.5.

b. Other Control Features of the Third Embodiment. As in the second embodiment of FIG. 2, the pump 32*b* in the third embodiment 98 of FIG. 3 is automatically turned on and off by the pump control subsystem 86*b* and the temperature output of the water heater 34*b* is automatically controlled by the thermostatic control subsystem 90*b*. Unlike the second embodiment, however, the third embodiment adds (i) an automatic heater power control subsystem 122 and (ii) a tub spout subsystem 124 as will be discussed presently.

In response to the shower system being placed in the fill, wash, or rinse modes, that is, any of the operational modes, the heater power control subsystem 122 is adapted to turn on the power to the heater 34*b*. However, when the main valve 30*b* is in its closed position, i.e., before or after the operation of the shower system, the heater power control subsystem 122 turns off the power to the heater. The subsystem 122 comprises the heater power switch 96*b* (which is connected between the heater 34*b* and a heater power location 126 indicated by a plus symbol), a heater on-off subcircuit 128 incorporated in the general control circuit 108, and an upper water sensor 125. (The upper water sensors 125 and 70, respectively, of the third and second embodiments, respectively, are preferably both flow sensors but are different kinds of flow sensors, as will later be described.) The heater on-off subcircuit 128 which incorporates the heater power switch 96*b* is operatively connected through the general control circuit 108 to the upper water sensor 125.

More specifically the upper water sensor 125, senses the flow of water at 130 in the upper pipe 54*b*, with the water being present at 130 only in the operational modes. When the main valve 30*b* is closed, the upper water sensor 125 senses zero water flow at 130. Responsive to a positive water presence signal or a zero water flow signal from the upper water sensor 125, the heater on-off subcircuit 128 turns on or off, respectively, the heater power switch 96*b*. If it happens that there is residual water remaining in the upper pipe at the sensing location 130, the water sensor 125 will not respond (since presumably it senses, not water presence, but water flow), and the heater 34*b* will shut off.

Turning to the tub spout subsystem 124, the third embodiment 98 unlike the second embodiment of FIG. 2, additionally comprises a conventionally known tub pipe 132 and tub spout 134 located in a bathtub portion 136 of a combined shower and bathtub enclosure 138. The tub spout 134 and the tub pipe 132, which is connected both at 140 to an upper extension portion 142 of the upper pipe 54*b* (which conducts water from the water heater 34*b* to the shower head 22*b*) and at 144 to the tub spout 134 are directed at enabling the person to fill the bathtub 136 with bath water without sending the water through the shower head 26. The tub spout subsystem 124 has an upper solenoid operated tub redirect valve 146, and integral with the tub spout, a conventional spout valve 148, which has a tub-filling down position and a flow stopping up position.

To take a tub bath instead of shower bath, a person leaves the spout valve 148 in its tub-filling down position and also manually closes a tub switch 150. Responsive to this, the general control circuit 108 acts to close the tub redirect valve 146, thereby stopping any flow of water through the upper extension pipe 142 above the branch location 140, so as to divert the water through the tub pipe 132 out the tub spout 134 directly into the bathtub 136.

For normal operation of the shower bath through the shower head 26, the person lifts a spout handle 152 upwardly, which moves the spout valve 148 to its flow stopping up position, and the person also manually opens the tub switch 150. The water is then directed from the heater **34*b* upwardly through the upper extension pipe 142 through the open tub redirect valve 146 further upwardly and out the shower head 26**.

5. The General Control Circuit

This section first provides an overview to the general control circuit 108 of the third embodiment, and then focuses on a detailed description of an inlet gate valve subcircuit 154 for operating the consumption control subsystem 100. (Additional details of the control circuit 108 are given later on in Further Technical Details.)

a. Overview. Referring to the two page schematic FIG. 10, the general control circuit 108 is generally organized around a trunk wire or conductor 156 seen in the lower half of sheet 9 extending horizontally rightwardly from 158 where it connects to the upper water switch 125 represented by a triangle. The general control circuit 108 incorporates the following main subcircuits: connected to the trunk conductor 156 at 160 and covering the upper two-thirds of sheet 9 the inlet gate valve subcircuit 154; also connected to the trunk conductor at 160 and appearing in the lower right-hand corner of sheet 9, a pump subcircuit 162 that turns on and off the pump **32*b*; connected to the trunk conductor at 164 and appearing in the lower left-hand corner of sheet 9 a drain subcircuit 166, which operates a drain solenoid 168 that opens and closes the drain valve 36*b*; connected on sheet 10 to where the trunk conductor 156 extends at 170, the thermostatic subcircuit 95*b*; and also connected at 170 to the trunk conductor 156, and incorporated in the thermostatic subcircuit 95, the heater on-off subcircuit 128** which turns the heater on and off.

The fact that all of these subcircuits are connected to the upper water switch 125 enables them to be turned on and off responsive to the presence or absence, respectively, of water flow at the upper water sensing location 130 in the upper pipe **54*b* of FIG. 3**.

There is provided in the control circuit a power assembly 172 shown on sheet 10 connected to external electric power, such as 220V AC, from external power source terminals 176, and adapted to convert in a direct current converter 178 incorporated therein the power into direct current, such as 12V DC. The direct current is supplied at direct current supply locations 180 to each of the various subcircuits (except the thermostatic subcircuit **95*b*). Direct current is returned to the power assembly via direct current power return locations 181. The assembly 172 also converts in a reference current converter 182** the external AC power into a lower voltage AC reference current the use of which will be described in Further Technical Details.

b. The Inlet Gate Valve Subcircuit. The inlet gate valve subcircuit 154, adapted to operate the consumption control subsystem 100 responsive to the inlet pressure switch 104 which is a simple on-off switch, comprises the direct current supply location 180, an inlet solenoid 184, an inlet switch 186, which is essentially a field effect power transistor, the previously introduced timer 106, and an "AND" gate 188. The AND gate 188 in turn comprises lower, middle, and upper diodes 190, 192, 194, respectively.

The inlet solenoid 184 is connected in an inlet solenoid subcircuit 196 between the direct current supply location 180 and a D terminal of the inlet switch 186. An S terminal of the inlet switch 186 in turn is connected to the direct current power return location 181. As used herein, the terms "D", "S", and "G terminals" will indicate drain, source, and gate terminals, respectively, of a field effect transistor, in this case, the inlet switch 186. The inlet switch 186 is able, by being gated "on" with the application of a sufficiently high positive voltage at its G terminal, to complete the inlet solenoid subcircuit 196 which acts to energize the inlet solenoid 184 which causes the inlet gate valve 102 to close. Alternatively, the inlet switch 186 is able by being gated "off" due to the absence of the voltage just described at the G terminal, to disconnect the inlet solenoid subcircuit 196 so as to de-energize the solenoid 184 thereby opening the inlet gate valve 102.

The inlet pressure switch 104 which is represented by a triangle is connected on one side to the direct current supply location 180, and on the other side, through a conductor 198, to a cathode side, indicated by a bar 200, of the lower diode 190. When the water pressure at the inlet sensing location 110 (shown in FIG. 3) is in relative terms high or low, respectively, the inlet pressure switch 104 is open or closed, respectively, which results in a potential at the cathode side 200 of the lower diode 190 that is relatively low or high, respectively. Since (as will be described more fully in this section) the relatively low potential which results at the cathode side of the lower diode when high pressure is sensed enables the diode to be in a conducting state, the high pressure signal effectively disables the timer 106.

(When current is said herein to flow in a particular direction, this means the direction of flow of positive charge, and also, the terms "high" or "low" voltage respectively, indicate a relatively higher or lower voltage relative to positive voltage.)

The timer 106, indicated in the upper left corner of the figure by a rectangle in dashed lines, comprises a combined oscillator-counter chip 202, such as for example a type 4060. This chip comprises a counter 204 connected to an oscillator 206. The oscillator 206 generates an oscillating signal, the cycles of which are counted by the counter 204, starting at a "zero time position", which corresponds to the starting position of the timer discussed previously and represented by the clock face with the hand 116 at the twelve o'clock position (as shown in clock face B of FIG. 5). The various connections that are shown in the Figure to the oscillator-counter chip are numbered in parenthesis ( ) using the standard terminal numbers (1) through (16) of the type 4060 chip known in the electronic art. Voltage is supplied to the oscillator counter chip 202 through a power terminal (illustrated as 16) of the chip from the direct current supply location 180.

The middle and upper diodes 192 and 194 of the AND gate 188 are collectively termed "timing diodes"

208. The oscillator-counter chip 202 connects through first and second timing terminals (shown as (1) and (2)) to the cathode sides 200 of each of the timing diodes 208. Once the counter 204 begins counting from its zero time position, initially there will be a low voltage at the cathode sides 200 of the timing diodes 208. At this moment, the timing diodes 208 will be in a conducting state, wherein this state corresponds to the previously described situation in which the timer 106 is just beginning to traverse its flow allowing region. As the timer 106 continues to advance through its flow allowing region, (depending as is known in the electronic art on the particular design of the timer 108 in light of the oscillating frequency and the desired timing) a high voltage will sometimes be applied at one or the other of the two timing diodes 208. For purposes of this description, the important point is that while the timer 106 is still traversing its flow allowing region, at least one of the cathode sides 200 of the two timing diodes 208 will be kept at the low voltage. At the end of the previously described first predetermined length of time (e.g., 45 seconds) the oscillator-counter chip 202 will apply relatively high voltages at the cathode sides 200 of both of the timing diodes 208, which will put both of the timing diodes 208 in a non-conducting state. This corresponds to the situation previously described (and shown in clock face D of FIG. 5) in which the timer 106 enters its flow stopping region.

The oscillator-counter chip 202 is provided with a reset terminal (shown as (12)). When more than a threshold voltage is applied to the reset terminal (12), the counter 204 is caused to return to its zero time position. If the greater than threshold voltage is applied continuously at the reset terminal (12), the counter 204 is effectively held at its zero time position. But when the voltage stops, the counter 204 is released so that it is able to advance.

The oscillator-counter chip has a self reset subcircuit 210 which connects a third timer terminal (illustrated as (3)) through a conductor to the reset terminal (12). At the end of the previously discussed second predetermined length of time (e.g., 15 seconds) of the inlet gate valve's control cycle, with the timer 106 advancing, this third timer terminal (3) applies a pulse of voltage to the reset terminal (12), which causes the counter 204 to be returned to its zero time position. This is the situation, previously described, shown in clock face F of FIG. 5, in which the timer 106 finishes traversing its flow stopping region, and, entering its flow allowing region, begins a new cycle.

The AND gate 188, which as mentioned comprises the lower diode 190 and the timing diodes 208, further comprises an AND gate direct current supply location 212 (which is simply one of the DC supply locations 180) connected via an AND gate resistor 214 and via a network 216 of conductors to anode sides 218 of the diodes 190, 208, or, also via the network 216 to the G terminal of the inlet switch 186. If any one (or all) of the diodes 190, 208 are in their conducting state, current is drawn through the diodes 190, 208 to left power returns designated 220. Two situations in which this happens are—the situation when the pressure at the pressure sensing location 110 is high, causing the inlet pressure switch 104 to be open resulting in low voltage at the cathode side 200 of the lower diode 190; or the situation when the timer 106 is in its flow allowing region, so that, as described above, there is low voltage at the cathode side 200 at least one of the timing diodes 208. This causes the voltage at the G terminal of the inlet switch 186 to be low, which causes the inlet switch 186 to be gated "off" which opens the inlet gate valve 102. (In the case where the inlet pressure switch 104 is open, causing low voltage to be applied at the cathode side of the lower diode, the timer 106 is effectively disabled.) But if all of the AND gate diodes 190, 208 are in their nonconducting state, which is the case when high voltage applied to all of their cathode sides 200, then the voltage which is supplied at the AND gate power supply location 212 will produce high voltage at the G terminal of the inlet switch 186 causing the inlet switch 186 to be gated "on" thereby closing the inlet gate valve 102.

To summarize the logic of the AND gate just described (assuming for present purposes that a disabling signal has not been sent by the upper water sensor 125, as will be described in the "Further Details" below):

(i) if the pressure at the inlet pressure sensing location 110 is high, or, the timer 106 is in its flow allowing region, the G terminal will be at low voltage and the inlet gate valve 102 will be open;

(ii) if the water pressure at 110 is low and the timer 106 is in its flow stopping region, the G terminal of the inlet switch 186 will be at high voltage and the inlet gate valve will be closed.

A final point in the basic description of the circuitry is that the conductor 198 which receives current from the inlet pressure switch 104 is connected through a branch location 222 to a left side of a timer reset capacitor 224. A right side of the timer reset capacitor 224 is connected in turn to the reset terminal (12) of the oscillator-counter chip 202. The right side of the timer reset capacitor 224 is also connected through a timer reset resistor 226 to the power return 181. Whenever a low pressure signal begins to be sent by the inlet pressure switch 104 via the conductor 198, normally this causes the timer reset capacitor 224 to send a spike or pulse voltage to the reset terminal (12), which immediately resets the counter 204 in the oscillator-counter chip of the timer. In effect, the capacitor 224, resistor 226, and power return 181 constitute a timer reset mechanism 228 that assures normally that following an onset of water inflow, which the inlet pressure sensor 104 begins to sense, the timer 106 will begin its control mode at its zero time position.

6. Further Technical Details

Figure 11:
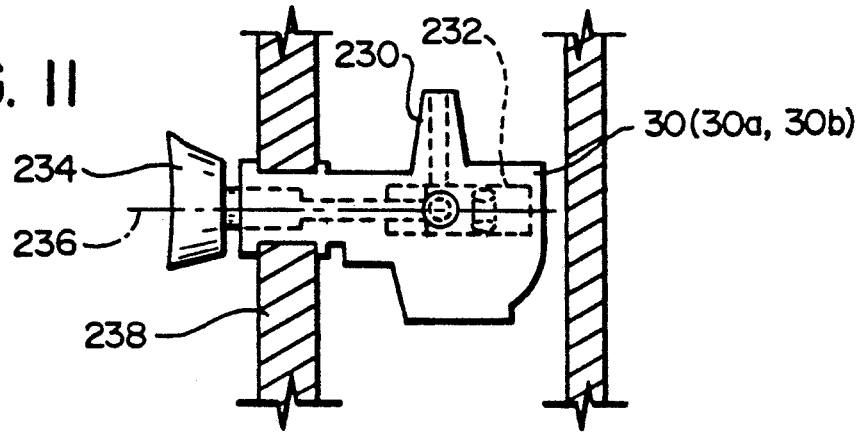
FIGS. 11 and 12 are side views of the main valve of the first, second and third embodiments, this valve being; pictured in the two figures, respectively, in its pushed-in "off" and pulled-out "on" positions.
Figure 12:
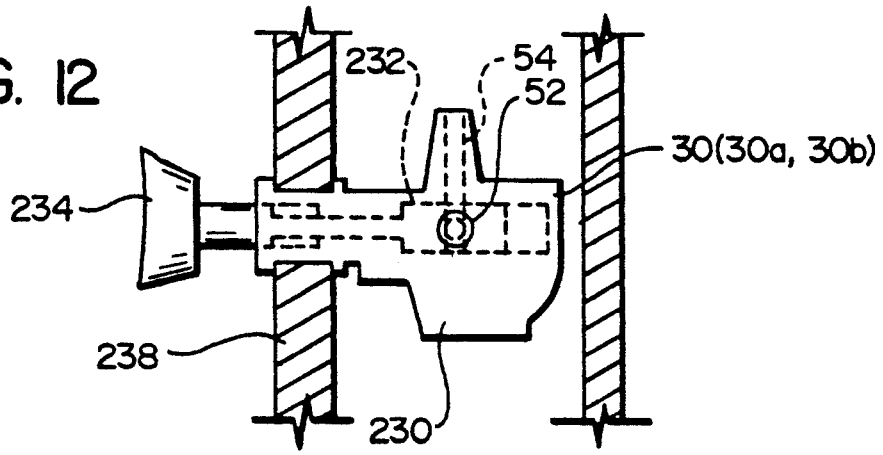

Having described main features of the invention, further technical details will now be provided.

a. The Main Valve. The main valve (30, 30*a*, and 30*b*) is shown in its closed "in" position in the exposed side view of FIG. 11, and in its operating "out" position in the similar view of FIG. 12. It comprises a stationary valve housing 230 and a movable internal valve element 232 connected to a movable manually graspable handle 234. The handle 234 and the valve element 232 move slideably along a sliding axis 236 and also rotatably about the axis 236. When the handle 234 is pushed in toward a wall 238 of the shower stall as in FIG. 11 the valve element blocks any flow through the main valve 30. But when the handle is pulled out by the person as in FIG. 12 the valve element and handle may then be rotated between different angular positions which correspond to the different operating positions of the main valve.

b. The Sensors and the Plumbing. The inlet pressure sensor or switch 104 of the third embodiment preferably is simply the same pressure sensor component that is commonly used in automobiles to sense the oil pressure of the engine so as to warn the driver when there is low oil pressure. The inlet pressure switch 104 is set at a level, such as for example 60 psi, so that the pressure switch in the consumption control subcircuit is open or closed, respectively, depending on whether the water pressure above or below the predetermined pressure level is sensed.

Figure 13:
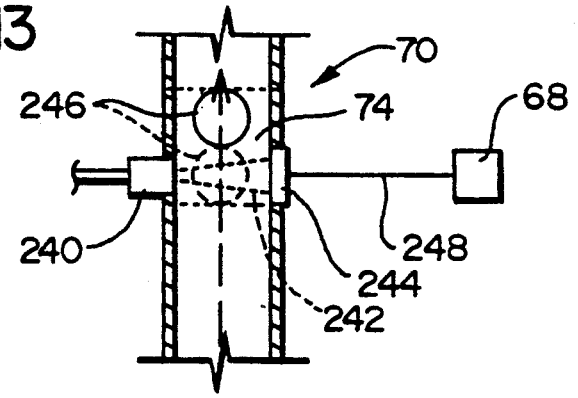
FIG. 13 is a schematic diagram of an optical water flow sensor used in the second embodiment.

The upper water sensor 70 of the second embodiment, as shown in FIG. 13, preferably is an optical flow sensor sensor adapted to respond to upward flow but not zero or downward flow. It comprises an optical beam source 240, which directs an optical beam 242 such as infrared rays through the upper pipe at the sensing location 74 to a photoelectric cell 244, and an opaque ball 246 located in the stream of water in the pipe. The ball 246 is moveable between an upper inactive position in solid line and a lower beam-blocking position in dotted line in which the ball 246 blocks the beam 242. The sensor 70 is connected by a conductor 248 to the control circuit 68. When the water is stationary (or moving downwardly) at the sensing location 74, the ball is held by its own weight in its lower position and the beam 242 is unable to reach the photoelectric cell 244, whereby a "zero flow" signal is produced and sent to the control circuit 68. However, when the water is flowing upwardly at the location 74, the ball is lifted upwardly by the force of the water on the ball so that the ball moves to an upper position and the beam 242 is able to reach the photoelectrical cell 244 which sends a "positive flow" signal to the control circuit 68. In the third embodiment shown in FIG. 3, as mentioned, the upper water sensor 125 like the sensor 70 of the second embodiment responds to upward flow in the upward pipe. However, this is a different kind of water sensor. Preferably it is a water pressure sensing device. Depending on whether water pressure at the sensing location 130 is above or below a predetermined pressure, say 5 P.S.I. the upper water sensor 125 is adapted to send a "positive flow" or a "zero flow" signal, respectively, by a conductor 249 to the control circuit 108. When the water is stationary or is flowing downwardly at 130, as occurs essentially in the off mode of the shower system, the line pressure at 130 will be below the predetermined amount. But when the water is flowing upwardly as occurs in the operating mode, the pressure will be above the predetermined amount and the upper water sensor 125 will send the "positive flow" signal to the control circuit 108.

These upper water sensors 70 and 125 of the second and third embodiments, respectively, are positioned differently relative to the pump **32*a*, 32*b*. The optical sensor 70 (FIG. 2) may be positioned at various locations below and above the pump in the upper pipe 54*a*, while the sensor 125 (FIG. 3) should be positioned above the pump 32*b* in order to function properly. It is also to be noted that the control circuits 68, 108 are arranged to delay the effect of a "zero flow" signal emanating from the sensor 70, 125** for a short while, such as three seconds. This is in case a temporary low pressure condition, such as an air bubble in the pipe, exists at the sensing location.

The pump **32, 32*a*, 32*b* of all the embodiments is adapted to allow pressurized water entering the pump from underneath to flow through the pump. It is practical then to arrange the on/off control for the pump in a manner that the pump is turned on only during the wash mode, with the external line pressure exerted at the fresh water inlet 28** supplying the necessary pressure to move the water through the system in both the fill and rinse modes.

Figure 14:
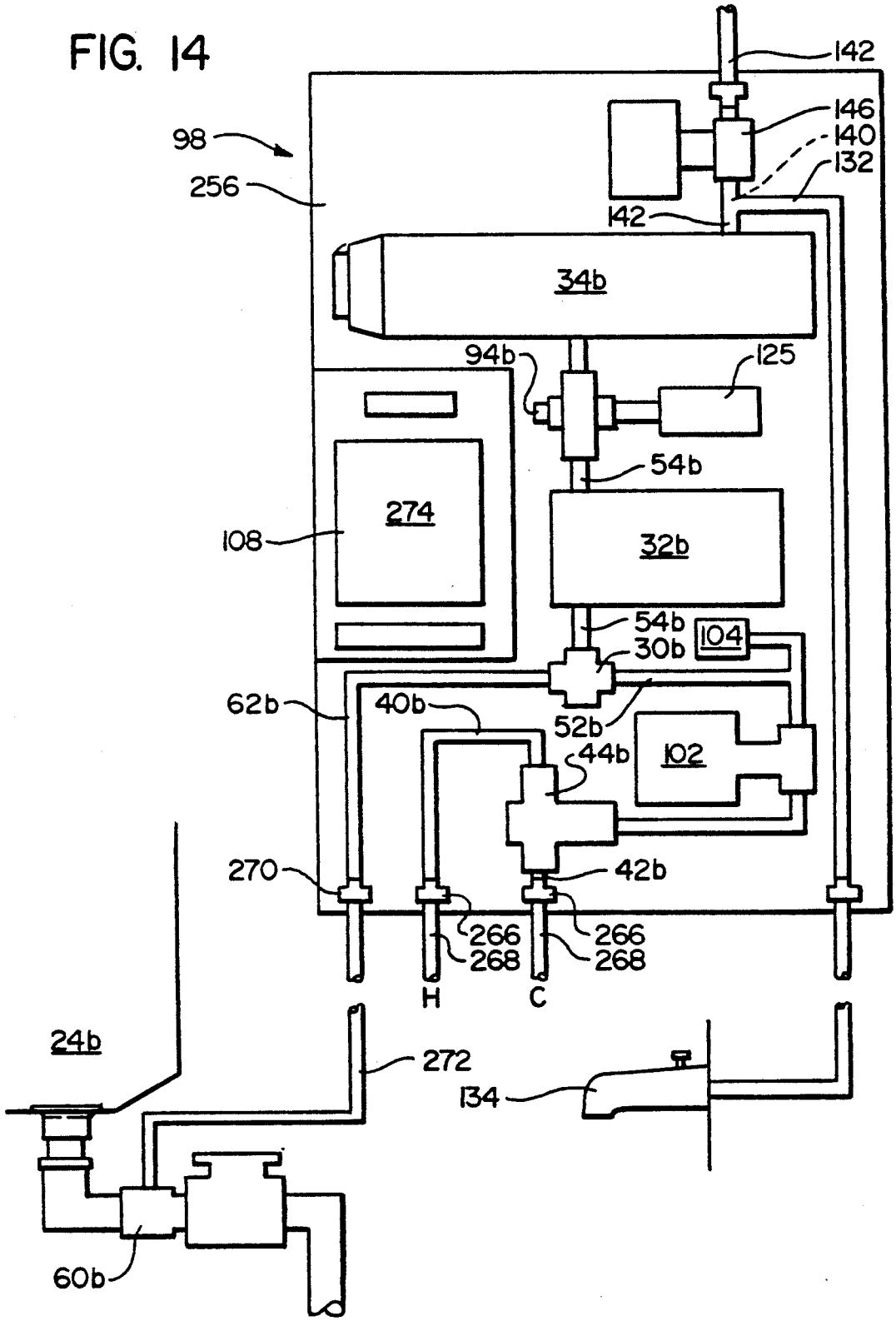
FIG. 14 is an exposed view of a module that packages components of the third embodiment.
Figure 15:
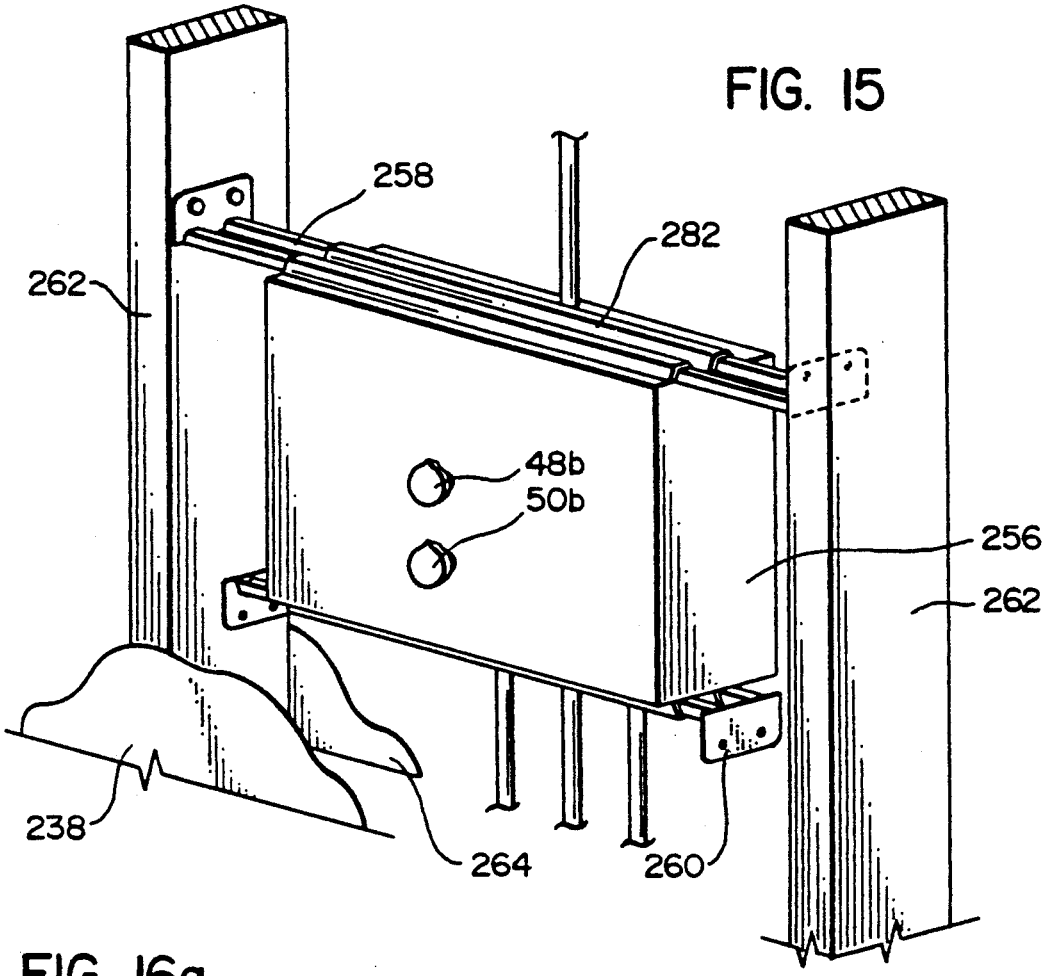
FIG. 15 is a perspective view from the front of the module of FIG. 14.

Particular portions of pipe in the third embodiment are numerically designated: an inlet to inlet valve portion 250, a T to drain valve portion 252, and a T to drain area portion 254.

c. Packaging and Installation. As shown in the front view of FIG. 14, major portions of the shower system, of the third embodiment 98 are packaged in a rectangular water control module or box 256. As shown in the perspective view of FIG. 15, the control box 256 is mounted on upper and lower supporting brackets 258 and 260 which in turn are attached to vertical studs 262 in a space between the wall sheath 238 of the shower stall (shown in FIG. 3) and a second wall sheath 264. Returning to FIG. 14, the interior of the water control box 256 includes the following components: the main valve **30*b*, the pump 32*b*, and the water heater 34*b*; portions of the hot and cold water pipes 40*b* and 42*b* which connect at 266 to external portions 268 of the hot and cold pipes. The water control box 256 further includes the hot and cold water mixing valve 44*b*; the right pipe 52*b*, and connected thereto, the inlet pressure switch 104 and the inlet gate valve 102. The water control box 256 also includes portions 54*b* and 142 of the upper pipe; a portion of the left pipe 62 which leads to the T-connection 60*b* outside the box; and a circuit board 274 which contains portions of the general control circuit 108. As seen in FIG. 15, the main control knob 48*b* and the mixing control knob 50*b* both protrude from the front of the water control box 256 through the wall 238** so that they may be reached by the person using the shower.

Figure 17:
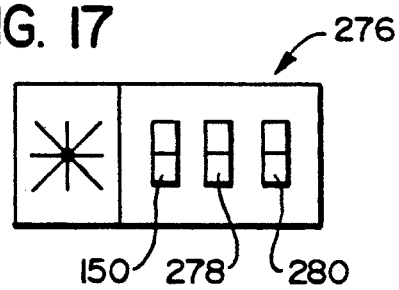
FIG. 17 is a front view of a wall mounted switch unit of the third embodiment.

A wall mounted control unit 276 shown in FIG. 17 is mounted on a wall in the bathroom area **10*b* and contains the tub switch 150, and two other switches, namely, a drain safety switch 278 and timer disable switch 280**.

Figure 10A:
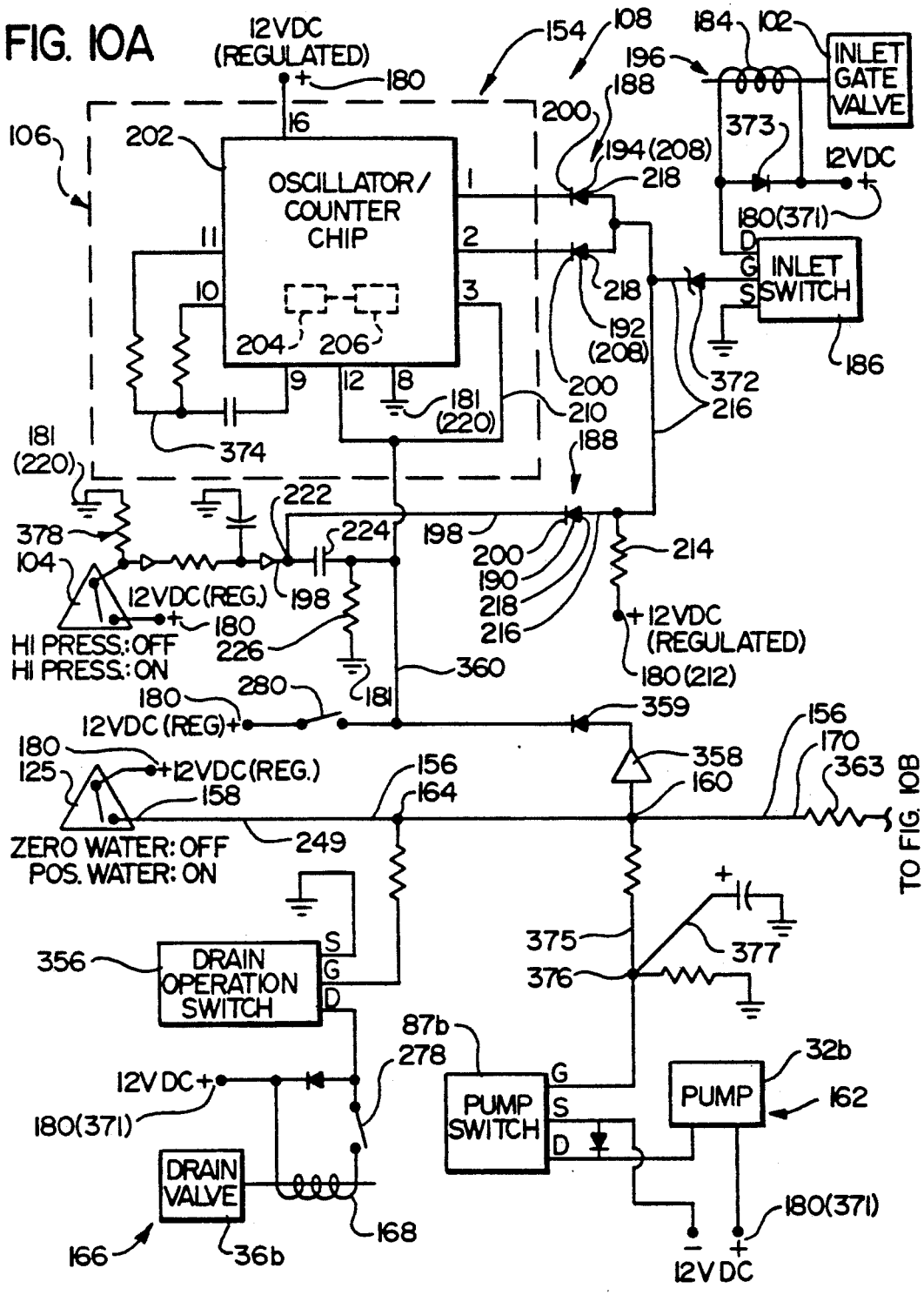
FIGS. 10*a* and 10*b* which appear on sheets 9 and 10 are a schematic diagram of the general control circuit of the third embodiment.
Figure 10B:
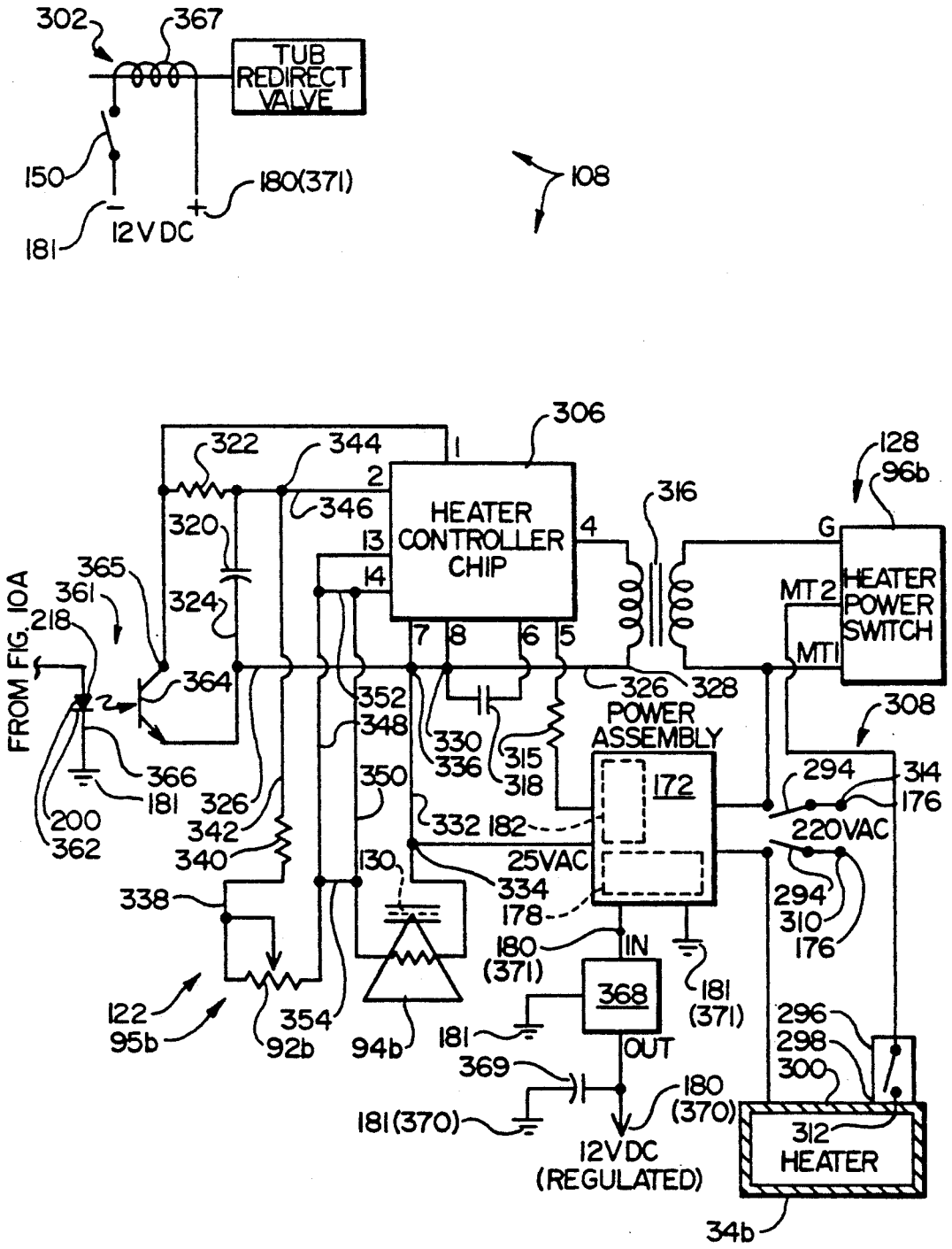
Figure 16A:
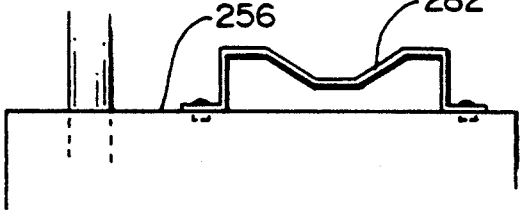
FIG. 16*a* through 16*c* are three detailed views labelled a, b, and c, of the brackets used to install the module of FIGS. 14 and 15.
Figure 16B:
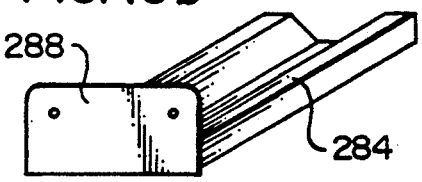
Figure 16C:
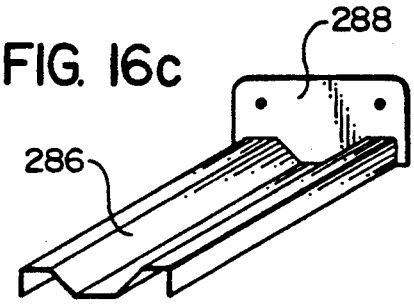

For ease of installation of the water control box within the space between the studs 262, as shown in FIG. 15 and the detail of FIG. 16, the top of the water control box 256 is fitted with a female rail track 282 having a transversely extending rail cavity. A separate left male rail and a right smaller profile male rail 286, each having a stud mounting face 288 are designed to be fitted within the M-shaped rail cavity of the female rail track 282, with the left rail 284 fitting from a left side and the right rail 286 fitting from the right side, into the cavity. As shown in FIG. 15, the rails may be moved slideably within the rail cavity so that the unit is able to be fitted between the studs 262.

d. Safety Features. In the third embodiment, the drain subcircuit 166 as shown in FIG. 10 contains the drain safety switch 278, which is able to be manually opened to break the circuit to de-energize the drain solenoid 168 thereby opening the drain valve **36*b* on demand. Also in FIG. 10, on sheet 10, the external power terminals 176 are connected to the heater 34*b* and also the power assembly 172 via main external power safety switches 294 which may be opened manually to disconnect the external power. Just above the heater 34*b*, a maximum temperature switch unit 296 is shown connected at 298 to an external housing 300 of the heater 34*b* and adapted to open the heater power circuit responsive to the temperature of the external housing 298** whenever the housing temperature exceeds a predetermined temperature level, such as for example 130° F.

This device may consist of simply a fuse, or may be modified to include a thermistor which detects the housing temperature.

In all embodiments, an overflow prevention duct 301 is provided that is positioned in an upper portion of the basin 24 (24a, 24b) and which leads downwardly to a drain. If the basin fills with water, at the level of the duct 301 the water begins to flow out the duct 301 (rather than overflowing out the top of the basin onto the floor.)

e. Control Circuit. This last section which describes further details of the control circuit 108 of the third embodiment will first describe thermostatic subcircuit 95b already introduced. A description of how the upper water sensor 125 controls the various subcircuits will then follow, after which a tub subcircuit 302, a regulated power subcircuit 304, and other details will be introduced.

The thermostatic subcircuit 95b, which is responsive to the potentiometer 92b and the thermistor 94b, has the following main components: the external power source terminals, the reference current converter, and the heater power switch, 176, 182, and 96b, respectively, already introduced, and a heater controller chip 306, which preferably is a TRIAC control chip such as for example type 3059. The heater power switch 96b preferably is a TRIAC such as for example a type TIC253D, or preferably a TECCOR Model Q4040P.

In a heater power subcircuit 308, a first terminal 310 of the external power source 176 is connected to one side of the heater 34b, while the other side 312 of the heater 34b is connected through the maximum temperature switch unit 296 to an MT2 terminal of the heater power switch 96b, with an MT1 terminal of the heater power switch 96b being connected to a second terminal 314 of the external power supply 176. The power supplied to the subcircuit 308 is alternating current. The TRIAC 96b automatically turns "off" at each zero crossing of the main alternating voltage in the subcircuit 308. When the external power safety switches 294 are all closed and when the heater power switch 96b is gated "on" each half cycle at its G terminal, specifically, by receiving an "on" gating or switching pulse signal carefully timed to switch power on as the voltage passes through zero in the normal cycle of the main alternating current, the heater power switch 96b is "on" which causes the heater 34b to operate. The reference current converter 182 supplies a lower voltage alternating current , such as for example 25 volts AC, which is in phase with the main alternating current, via a resistor 315 to a terminal (5) of the heater controller chip 306 which in turn uses this power to produce the previously described "on" gating pulse signal to the heater power switch 96b. The reference power is also rectified by the heater controller chip 306 to supply direct current to operate the internal circuitry of the chip 306 and to excite the potentiometer 92b and the thermistor 94b.

Various connections which will be described later operatively connect the potentiometer 92b and thermistor 94b to the heater controller chip 306. The heater controller chip 306 is also connected via its pulse terminal (4) and via a transformer 316, to the G terminal of the heater power switch 96b.

In operation of the thermostatic subcircuit 95b, the person first sets the potentiometer 92b at an appropriate temperature setting of the desired water temperature. As the water flows through the sensing location 130 of the thermistor 94b (also shown in FIG. 3) a resistance of the thermister 94b will vary according to the water temperature. The heater controller chip 306 compares the resistances of the potentiometer 92b and the thermistor 94b. Whenever the thermistor 94b registers a temperature which is below the temperature setting of the potentiometer 92b, the heater controller chip 306 puts out the "on" gating pulse signal, which is relayed by the transformer 316 to the G terminal of the heater power switch 96b, which is gated "on", causing the heater 34b to stay on and heat up the water. When the thermistor 94b registers a resistance which indicates to the controller chip 306 that the temperature of the water is equal to or above the temperature setting, then the "on" gating pulse signal stops, and the heater power switch 96b remains "off" thereby permitting the heater 34b to stay off so that the water begins to cool.

It is highly desirable that the "on" gating pulse signal, which is a short "spike" signal, be timed to occur as close as possible to the zero crossing of the alternating current at each half cycle thereof; otherwise electrical "noise", including radio frequency interference is created. Such timing of the pulse is accomplished by using, as just described, the reference voltage which is connected to the chip.

Other components of the thermostatic subcircuit 95b include capacitors 318 and 320 and a first resistor 322. Terminal (1) of the heater controller chip 306 is connected to the left side of the first resister 322. Terminal (2) is connected to the right side of the resistor 322 which is connected in turn to an upper side of the capacitor 320. The lower side of the capacitor 320 is connected through a short conductor 324 to a main horizontal conductor 326, a right end 328 of which is connected to the bottom of a primary winding of the transformer 316. The capacitor 318 has its right side connected to a terminal (6) of the chip and its left side connected through a contact 330 of the main horizontal conductor 326 to the terminal (8) of the chip. A right side of the thermistor 94b is connected to a vertical conductor 332 which connects at a power connection 334 to the reference power converter 182. The vertical conductor also connects also at an intersection 336 to the main horizontal connector 326, and additionally connects to the terminal (7) of the chip. A left side 338 of the potentiometer 92b connects through a second resistor 340 to an upright conductor 342 which connects at a location 344 to another short conductor 346 that connects the terminal (2) of the chip 306 and also to the right side of the first resistor 322. The right side of the potentiometer 92b connects through a middle conductor 348 to a terminal (13) of the chip 306, while a left side of the thermistor 94b connects through a second middle conductor 350 to a terminal (14) of the chip 306. The middle conductor 348 and the second middle conductor 350 connect to one another at both an upper location 352 and a lower location 354.

Turning to the operation of the upper water sensor or switch 125, as previously mentioned one side of the switch 125 is connected to the DC power supply 180 and the other side is connected through the trunk conductor 156 to the main subcircuits of the general control circuit 108. When an "on" signal, which occurs as described before if water flow is present at the sensing location 130 in the upper pipe 54b, is sensed at a G terminal of a drain operation switch 356 (which is a field effect power transistor or MOSFET, such as for example a BUZ11), so that the drain operation switch 356 is gated "on", the drain solenoid 168 is energized which acts to close the drain valve 36b. An "off" signal from the upper water switch 125 has the opposite effect so as to open the drain valve 36b. An "on" signal from the upper water switch 125 has a similar effect on the pump 32b as on the drain valve 36b. More specifically, the current from the upper water switch 35b is received at a G terminal of the previously introduced pump switch 87b (which is also a Mosfet such as for example an IRFZ40/42), so that the pump switch 87b is gated "on" which turns on the pump 32b. Again an "off" signal from the upper water switch 125 gates "off" the pump switch 87b which turns off the pump 32b.

The upper water switch 125 is connected, through the junction 160 leading to the inlet gate valve subcircuit 154 through an inverted amplifier 358 (such as for example one of the six standard amplifier subcomponents of a type 4584 amplifier chip) through a diode 359 through a vertical conductor 360 to the reset terminal (12) of the oscillator-counter chip 202. When the upper water switch 125 is in its "off" position, there is low voltage at a bottom side of the inverted amplifier 358 which in turns produces a high voltage in the vertical conductor 360 which is applied at the reset terminal (12) thereby disabling the counter 204 so that, in effect, whenever the shower system is between operations, with zero water in the upper pipe 54b, the timer 106 is disabled. However, when water is present, the upper water switch 125 is "on" which results in a low voltage applied at the reset terminal (12) so that the timer 106 may operate. The upper water switch 125 also operates through the previously mentioned heater on-off subcircuit 122 to turn on and off the heater 34b. The thermostatic subcircuit 95b and the heater on-off subcircuit 122 (which is incorporated therein) are both optically isolated from the other subcircuits of the general control circuit 108 by the use of a light emitting diode or photo isolator group 361 shown on sheet 10, comprising a light emitting diode 362, a resistor 363, a power return 181, and a receiving or photo transistor 364. This prevents electrical "noise" generated by the heater circuits on sheet 10 from affecting the other subcircuits on sheet 9. The heater on-off subcircuit 122 has as its main operative parts the main trunk conductor 156 from the upper water switch 125, the photo isolator group 361, the heater control chip 306, and the heater power switch 96b. The heater on-off subcircuit 122 operates as follows: when the upper water switch 125 senses zero water flow and is "off" there is low voltage at a left side of the photo isolator unit 361 which disables the heater controller chip 306 from sending the "on" gating pulse signal thereby effectively keeping the heater 34b off. But when the upper water switch 125 is "on" indicating there is water flow in the upper pipe 54b, there is a high voltage at the left side of the photo isolator group 361 which in effect permits the heater controller chip 306 to operate so that it may turn on and off the heater 34b at the times dictated by the thermostatic subcircuit 95b. To describe the connections specifically the right side 170 of the main trunk conductor 156 is connected to the resistor 363. A right side of the resistor 363 is connected to the anode side 218 of the light emitting diode 362. The collector side 365 of the photo resistor 364 is connected to the left side of the first resistor 322 previously introduced. A cathode side 200 of the light emitting diode 362 is connected to the power return 181 through a power return connection 366. The lower emitter side of the photo transistor 364 is connected to the previously introduced main horizontal connector 326 which is connected to the pins (7) and (8) of the chip 306 and also at 328 at the transformer 316.

The tub subcircuit 302 comprises a tub DC power supply 180 which is connected to the right side of a tub solenoid 367 a left side of which is connected through the previously introduced tub switch 150 to the power return 181. When the switch 150 is closed, the solenoid is energized which acts to close the tub redirect valve.

The regulated power subcircuit 304 shown at the bottom of sheet 10 comprises the direct current converter 178, a three terminal regulator chip 368, such as for example type 78M08, a capacitor 369, the power return 181, and a DC regulated output location 370. The regulated power subcircuit takes unregulated DC power from the direct current converter 178 and converts it into regulated DC power which is supplied through the DC regulated output location 370 to various regulated DC power inputs of the control circuit 108 indicated by the word "(Regulated)". The regulated voltage has a relatively constant voltage, while the unregulated voltage, which is provided directly from an unregulated output terminal 371 of the direct current converter 178 to other DC power input locations of the control circuit, varies substantially. The unregulated current is able to be used by the pump subcircuit 162 that operates the pump 32b, the drain subcircuit 166 that operates the drain valve 36b, the previously introduced inlet solenoid subcircuit 196 and tub subcircuit 302.

To provide additional details, first, the network 216 of the AND gate 188 supplies its voltage to the G terminal of the inlet switch 188 through a Zener diode 372. This protects the inlet solenoid subcircuit 196 from "noise", i.e., underthreshold signals originating from the remainder of the inlet gate valve subcircuit 154 to the left of the diode 372. There is also a diode 373 between the inlet solenoid power supply location 180 and the D terminal of the inlet switch 186. Secondly, the terminal (8) of the oscillator-counter chip 202 is connected to the power return 181, and terminals (9), (10), (11) of the chip 202 are connected to a frequency setting network 374. This network 374 helps to establish the frequency of the oscillator 206, which is for example 135Hz.

Thirdly, the previously introduced timer disable switch 280 (which is found on the wall mounted control unit 276) is connected between the DC power supply 180 and the reset terminal (12) of the oscillator-counter chip 202. When the switch 280, which is normally open, is manually closed, continuous voltage is supplied to the reset terminal (12) effectively disabling the water consumption control system 100. Fourthly, to a pump conductor 375 running from the trunk conductor 156 to the pump switch 87b, there is also connected a connection location 376 a noise reduction network 377. Fifthly, there is provided between the pressure sensing switch 104 and the conductor 198 a bounce elimination network 378 which is designed to screen out electrical noise caused by "bouncing" of the pressure sensing switch 104. The network 378 includes the left power return 220.

Finally, for production purposes an eight volt regulated power supply voltage is preferred to the twelve volt regulated voltage shown.

It is to be noted that the hot and cold mixing valve 44 (44a, 44b) in all the embodiments preferrably is an automatic proportional thermostatic mixing valve, such as a valve sold under the trademark Aquamix manufactured by Sparco, Inc. A knob is turned to set the temperature at a comfortable temperature on a continuous scale (as for example from one to four). The mixing valve then can be left in the original position and water will be supplied at or close to the desired temperature each time the shower is used, because the valve will adjust the proportion of hot and cold water.

It is to be understood that modifications may be made of the foregoing description of the present invention without departing from the basic teachings thereof.

What is claimed is:

1. A shower system adapted to be operated to receive and deliver fresh water for a washing operation and also to recirculate water through the system operation washing, said system comprising:

a. a shower head to discharge water to a washing area;

b. a basin to receive said water from the shower head;

c. a fresh water inlet adapted to be connected to a fresh water source;

d. a waste water outlet line having an upstream end to receive waste water from said basin and a downstream end adapted to carry water from said basin to a waste area;

e. a main valve having operative connections to said shower head, to said fresh water inlet, and to said waste water outlet line;

f. a waste water outlet control valve connected to said waste water outlet line at a waste water shutoff location to control flow of waste water through said waste water outlet line to said waste area;

g. a fresh water supply line connecting said fresh water inlet to said main valve;

h. a shower head supply line leading from said main valve to said shower head, said fresh water supply line forming with said shower head supply line a fresh water supply circuit;

i. a recirculating line having a first end connecting to said waste water outlet line at a location upstream of said shutoff location of the waste water outlet control valve and a second end connected to said main valve, said recirculating line forming with said shower head supply line a recycling circuit;

j. said main valve having at least two operating positions, namely:

i. a first operating position by which a flow connection is made between said fresh water supply line and said shower head supply line to supply fresh water to said shower head;

ii. a second operating position by which a connection is made from said recirculating line to said shower head supply line to recirculate waste water discharged from said shower head;

k. a pump means operatively connected in said recirculating circuit to pump water from said waste water outlet into said shower head;

l. a hot water/cold water mixing control valve connected to said fresh water supply line upstream of said main valve;

whereby with said main valve in its first operating position and said waste water outlet control valve being in its open position, fresh water can be delivered to said shower head to pass out said waste water line to said waste area, and with said main valve in its second operating position and said waste water control valve being in its closed position, said pump means is able to recirculate waste water from said basin to said shower head.

2. A shower system adapted to be operated to receive and deliver fresh water for a washing operation and also to recirculate water through the system for washing, said system comprising:

a. a shower head to discharge water to a washing area;

b. a basin to receive said water from the shower head;

c. a fresh water inlet adapted to be connected to a fresh water source;

d. a waste water outlet line having an upstream end to receive waste water from said basin and a downstream end adapted to carry water from said basin to a waste area;

e. a main valve having operation connections to said shower head, to said fresh water inlet, and to said waste water outlet line;

f. a waste water outlet control valve connected to said waste water outlet line at a waste water shutoff location to control flow of waste water through said waste water outlet line to said waste area;

g. a fresh water supply line connecting said fresh water inlet to said main valve;

h. a shower head supply line leading from said main valve to said shower head, said fresh water supply line forming with said shower head supply line a fresh water supply circuit;

i. a recirculating line having a first end connecting to said waste water outlet line at a location upstream of said shutoff location of the waste water outlet control valve and a second end connected to said main valve, said recirculating line forming with said shower head supply line a recycling circuit;

j. said main valve having at least two operating positions, namely:

i. a first operating position by which a flow connection is made between said fresh water supply line and said shower head supply line to supply fresh water to said shower head;

ii. a second operating position by which a connection is made from said recirculating line to said shower head supply line to recirculate waste water discharged from said shower head;

iii. a third operating position, in which fresh water is delivered both to said shower head supply line and to said recirculating line, whereby water can be supplied throughout said recirculating circuit prior to operating the system in a recirculating mode of operation;

k. a pump means operatively connected in said recirculating circuit to pump water from said waste water outlet into said shower head;

whereby with said main valve in the first operating position and said waste water outlet control valve being in its open position, fresh water can be delivered to said shower head to pass out said waste water line to said waste area, and with said main valve in its second operating position and said waste water control valve being in its closed position, said pump means is able to recirculate waste water from said basin to said shower head.

3. The system as recited in claim 2, wherein said pump means is connected to said shower head supply line between said main valve and said shower head.

4. A shower system adapted to be operated to receive and deliver fresh water for a washing operation and also to recirculate water through the system for washing, said system comprising:

a. a shower head to discharge water to a washing area;

b. a basin to receive said water from the shower head;
c. a fresh water inlet adapted to be connected to a fresh water source;
d. a waste water outlet line having an upstream end to receive waste water from said basin and a downstream end adapted to carry water from said basin to a waste area;
e. a main valve having operative connections to said shower head, to said fresh water inlet, and to said waste water outlet line;
f. a waste water outlet control valve connected to said waste water outlet line at a waste water shutoff location to control flow of waste water through said waste water outlet line to said waste area;
g. a fresh supply line connecting said fresh water inlet to said main valve;
h. a shower head supply line leading from said main valve to said shower head, said fresh water supply line having forming with said shower head supply line a fresh water supply circuit;
i. a recirculating line having a first end connecting to said waste water outlet line at a location upstream of said shutoff location of the waste water outlet control valve and a second end connected to said main valve, said recirculating line forming with said shower head supply line a recycling circuit;
j. said main valve having at least two operating positions, namely:
   i. a first operating position by which a flow connection is made between said fresh water supply line and said shower head supply line to supply fresh water to said shower head;
   ii. a second operating position by which a connection is made from said recirculating line to said shower head supply line to recirculate waste water discharged from said shower head;
k. a pump means operatively connected in said recirculating circuit to pump water from said waste water outlet into said shower head;
l. said main valve and said waste water outlet control valve being each separately operated and each being adapted to be manually operated;

whereby said main valve in its first operating position and said waste water outlet control valve being in its open position, fresh water can be delivered to said shower head to pass out said waste water line to said waste area, and with said main valve in its second operating position and said waste water control valve being in its closed position, said pump means is able to recirculate waste water from said basin to said shower head.

5. A shower system adapted to be operated to receive and deliver fresh water for a washing operation and also to recirculate water through the system for washing, said system comprising:

a. a shower head to discharge water to a washing area;
b. a basin to receive said water from the shower head;
c. a fresh water inlet adapted to be connected to a fresh water source;
d. a waste water outlet line having an upstream end to receive waste water from said basin and a downstream end adapted to carry water from said basin to a waste area;
e. a main valve having operative connections to said shower head, to said fresh water inlet, and to said waste water outlet line;
f. a waste water outlet control valve connected to said waste water outlet line at a waste water shutoff location to control flow of waste water through said waste water outlet line to said waste area;
g. a fresh water supply line connecting said fresh water inlet to said main valve;
h. a shower head supply line leading from said main valve to said shower head, said fresh water supply line forming with said shower head supply line a fresh water supply circuit;
i. a recirculating line having a first end connecting to said waste water outlet line at a location upstream of said shutoff location of the waste water outlet control valve and a second end connected to said main valve, said recirculating line forming with said shower head supply line a recycling circuit;
j. said main valve having at least two operating positions, namely:
   i. a first operating position by which a flow connection is made between said fresh water supply line and said shower head supply line to supply fresh water to said shower head;
   ii. a second operating position by which a connection is made from said recirculating line to said shower head supply line to recirculate waste water discharged from said shower head;
k. a pump means operatively connected in said recirculating circuit to pump water from said waste water outlet into said shower head;
l. a waste outlet control valve control means to move said waste water outlet control valve between its open and closed position in response to said main valve being in its second operating position with flow of water taking place in both said shower head supply line and said recirculating line, whereby said waste water outlet control valve is closed while waste water is recirculating through said system;

whereby with said main valve in its first operating position and said waste water outlet control valve being in its open position, fresh water can be delivered to said shower head to pass out said waste water line to said waste area, and with said main valve in its second operating position and said waste water control valve being in its closed position, said pump means is able to recirculate waste water from said basin to said shower head.

6. The system as recited in claim 5, wherein said pump means is connected to said shower head supply line between said main valve and said shower head, and said control means causes said waste water outlet control valve to be closed.

* * * * *